US008573415B2

(12) United States Patent
Ernst et al.

(10) Patent No.: US 8,573,415 B2
(45) Date of Patent: Nov. 5, 2013

(54) STORAGE SYSTEM

(75) Inventors: Richard J. Ernst, San Diego, CA (US); John P. Grimm, Santee, CA (US)

(73) Assignee: Illinois Tool Works Inc., Glenview, IL (US)

( * ) Notice: Subject to any disclaimer, the term of this patent is extended or adjusted under 35 U.S.C. 154(b) by 154 days.

(21) Appl. No.: 13/099,563

(22) Filed: May 3, 2011

(65) Prior Publication Data

US 2011/0266283 A1 Nov. 3, 2011

Related U.S. Application Data

(60) Provisional application No. 61/330,808, filed on May 3, 2010, provisional application No. 61/415,595, filed on Nov. 19, 2010.

(51) Int. Cl.
*A47F 5/08* (2006.01)

(52) U.S. Cl.
USPC ..... 211/90.01; 211/90.04; 211/183; 248/220.21; 248/223.41; 248/225.21

(58) Field of Classification Search
USPC ..... 248/222.2, 225.2, 220.21, 223.41; 52/239, 588; 211/87, 94, 189
See application file for complete search history.

(56) References Cited

U.S. PATENT DOCUMENTS

| | | | | |
|---|---|---|---|---|
| 221,809 | A | 11/1879 | Greig | |
| 4,189,123 | A | 2/1980 | Johnson | |
| 4,311,295 | A | 1/1982 | Jamar, Jr. | |
| 4,618,192 | A | 10/1986 | Kelley | |
| 4,693,381 | A * | 9/1987 | Lodge | 211/94.01 |
| 4,817,900 | A | 4/1989 | Whittington et al. | |
| 4,825,601 | A * | 5/1989 | Halverson | 52/36.4 |
| 4,869,378 | A | 9/1989 | Miller | |

(Continued)

FOREIGN PATENT DOCUMENTS

| | | |
|---|---|---|
| FR | 2547522 A1 | 12/1984 |
| FR | 2580214 | 10/1986 |

OTHER PUBLICATIONS

International Preliminary Report on Patentability and Written Opinion of the International Searching Authority for PCT/US2011/034979, issued Nov. 6, 2012 (8 pages).

*Primary Examiner* — Amy J Sterling
(74) *Attorney, Agent, or Firm* — Mark Croll; Patricia Chidiac; Beem Patent Law Firm

(57) ABSTRACT

In one aspect, a storage system is disclosed. The storage system may include a base having a lower or accessory portion and an upper portion, wherein the lower portion has at least one lower projection extending outward from a front surface and wherein the upper portion has at least two upper projections extending outward from the front surface and spaced from the lower projection. The system may also include at least one accessory configured to engage the lower portion. The system further may include at least one shelf or cover configured to engage the two upper projections. In a further aspect, another storage system is disclosed, wherein the storage system may include a base having an upper ledge portion, wherein a portion of the upper ledge portion is spaced a predetermined distance from a wall. The base further may include a lower portion and an accessory portion between the upper ledge portion and the lower portion. The system further may include at least one accessory configured to engage the accessory portion. The system also may include at least one shelf or cover configured to couple to the base.

15 Claims, 17 Drawing Sheets

(56) References Cited

U.S. PATENT DOCUMENTS

| | | | |
|---|---|---|---|
| 4,942,498 | A | 7/1990 | Toussaint |
| 5,048,698 | A | 9/1991 | Konrad |
| 5,125,518 | A | 6/1992 | Ward |
| 5,337,987 | A | 8/1994 | Sawatsky |
| 5,379,976 | A | 1/1995 | DeGirolamo |
| 5,429,252 | A | 7/1995 | Liu |
| 5,641,079 | A | 6/1997 | Schmidt |
| 5,775,521 | A | 7/1998 | Tisbo |
| 5,960,967 | A | 10/1999 | Neil |
| 6,050,426 | A | 4/2000 | Leurdijk |
| 6,119,878 | A | 9/2000 | Zen |
| 6,152,312 | A | 11/2000 | Nava et al. |
| 6,286,802 | B1 | 9/2001 | Munson et al. |
| 6,299,001 | B1 | 10/2001 | Frolov et al. |
| 6,349,507 | B1 | 2/2002 | Muellerleile |
| 6,499,608 | B1 * | 12/2002 | Sterling et al. ..... 211/70.6 |
| 6,578,498 | B1 | 6/2003 | Draudt et al. |
| 6,698,603 | B2 | 3/2004 | Lawson et al. |
| 7,014,052 | B2 | 3/2006 | Dettorre et al. |
| 7,137,515 | B1 | 11/2006 | Lawson et al. |
| 7,147,115 | B2 | 12/2006 | Perkins et al. |
| 7,228,977 | B2 | 6/2007 | Perkins et al. |
| 7,686,172 | B2 | 3/2010 | Wisnoski et al. |
| 7,686,265 | B2 | 3/2010 | Hall |
| 8,066,130 | B2 | 11/2011 | Shaha et al. |
| 2004/0169116 | A1 | 9/2004 | Nogare et al. |
| 2005/0236544 | A1 | 10/2005 | Mancino et al. |
| 2005/0247653 | A1 | 11/2005 | Brooks |
| 2006/0180561 | A1 | 8/2006 | Wisnoski et al. |
| 2008/0047911 | A1 | 2/2008 | Kao |
| 2009/0230067 | A1 | 9/2009 | Shaha et al. |
| 2009/0230267 | A1 | 9/2009 | Ernst et al. |

* cited by examiner

STORAGE SYSTEM

CROSS-REFERENCE TO RELATED APPLICATIONS

The present application claims benefit of priority of U.S. Provisional Application 61/330,808, filed on May 3, 2010, and U.S. Provisional Application 61/415,595, filed on Nov. 19, 2010.

BACKGROUND OF THE INVENTION

1. Field of the Invention

The present invention is directed to a storage system, mountable on a wall for holding or organizing an object or plurality of objects such as household items.

2. Description of the Related Art

Wall mounted storage systems have traditionally come in pegboard or those that use variations of a slot-wall. Pegboard storage systems suffer from limiting a user to install hooks or objects at predetermined locations and typically are large and take up several square feet of wall space. In addition, hooks inserted into pegboard limit the type of objects that may be hung from such hooks. For example, a traditional pegboard hook would not allow a user to hang a ladder, rake, bicycle or other such object with substantial height. Slot-wall systems may be slightly cumbersome for a user, as these systems generally require at least one open side in order to insert hooks or other attachments.

These systems typically are time intensive to install as many holes need to be drilled and measured to ensure the systems are installed properly and level, and a significant number of screws are generally used to affix the systems to the wall.

What is needed is a storage system mountable to a wall that may be easily installed at any number of locations chosen by a user, whereby the storage system has increased usability, function, pullout resistance and load capacity.

BRIEF SUMMARY OF THE INVENTION

In one aspect of the invention, a storage system includes a base having a lower or accessory portion and an upper portion, wherein the lower portion has at least one lower projection extending outward from a front surface and wherein the upper portion has at least two upper projections extending outward from the front surface and spaced from the lower projection. The system also may include at least one accessory having a mounting plate with at least two rearwardly extending tabs and a generally symmetrically wireform having a pair of legs with a portion therebetween, wherein the accessory is configured to engage the lower portion. The system further may include at least one shelf or cover configured to engage the two upper projections.

In another aspect of the invention, a storage system is disclosed. The storage system may include a base having an upper ledge portion, wherein a portion of the upper ledge portion is spaced a predetermined distance from a wall. The base further may include a lower portion and an accessory portion between the upper ledge portion and the lower portion. The system further may include at least one accessory configured to engage the accessory portion. The system also may include at least one shelf or cover configured to couple to the base.

These and other features and advantages are evident from the following description of the present invention, with reference to the accompanying drawings.

DETAILED DESCRIPTION

Figure 1:
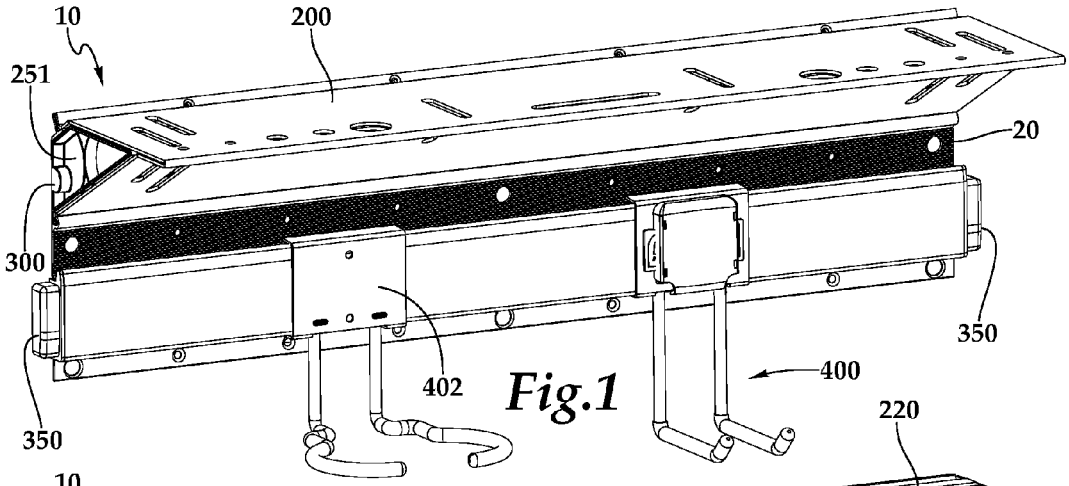
FIG. 1 is a perspective view of one embodiment of a storage system mountable to a wall.
Figure 1C:
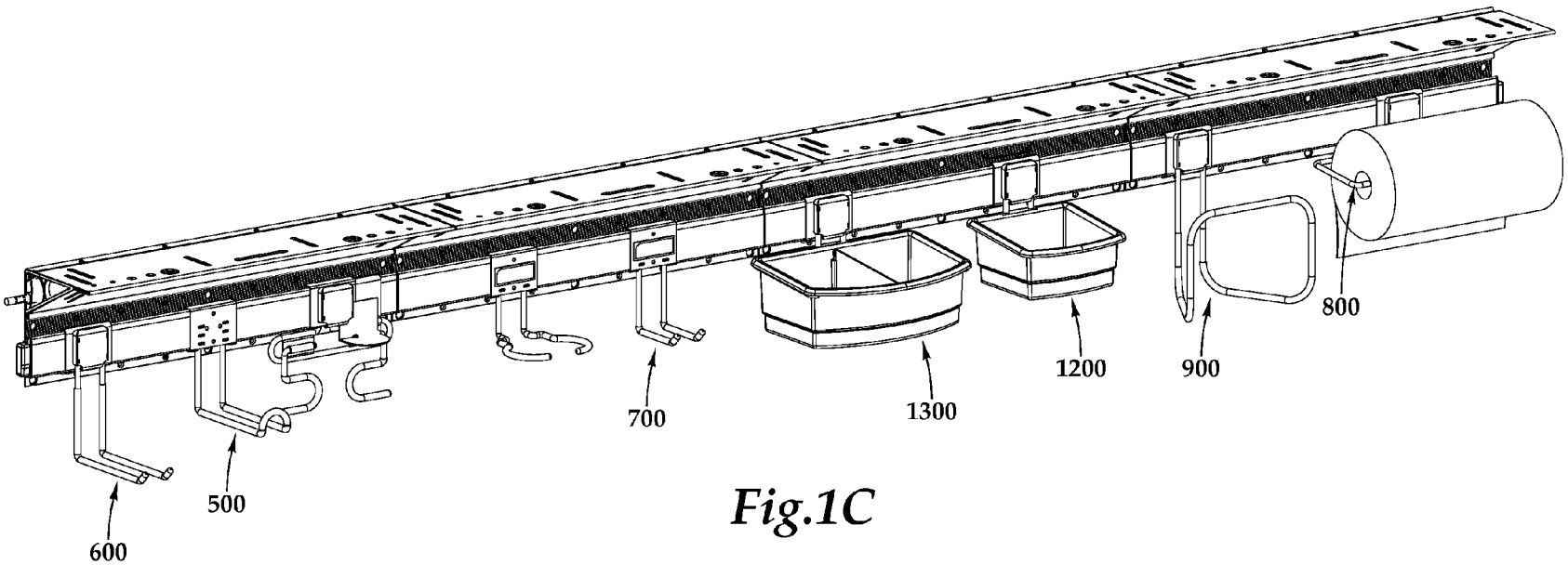
FIG. 1C is a perspective view of a plurality of storage system shown in FIG. 1.
Figure 2:
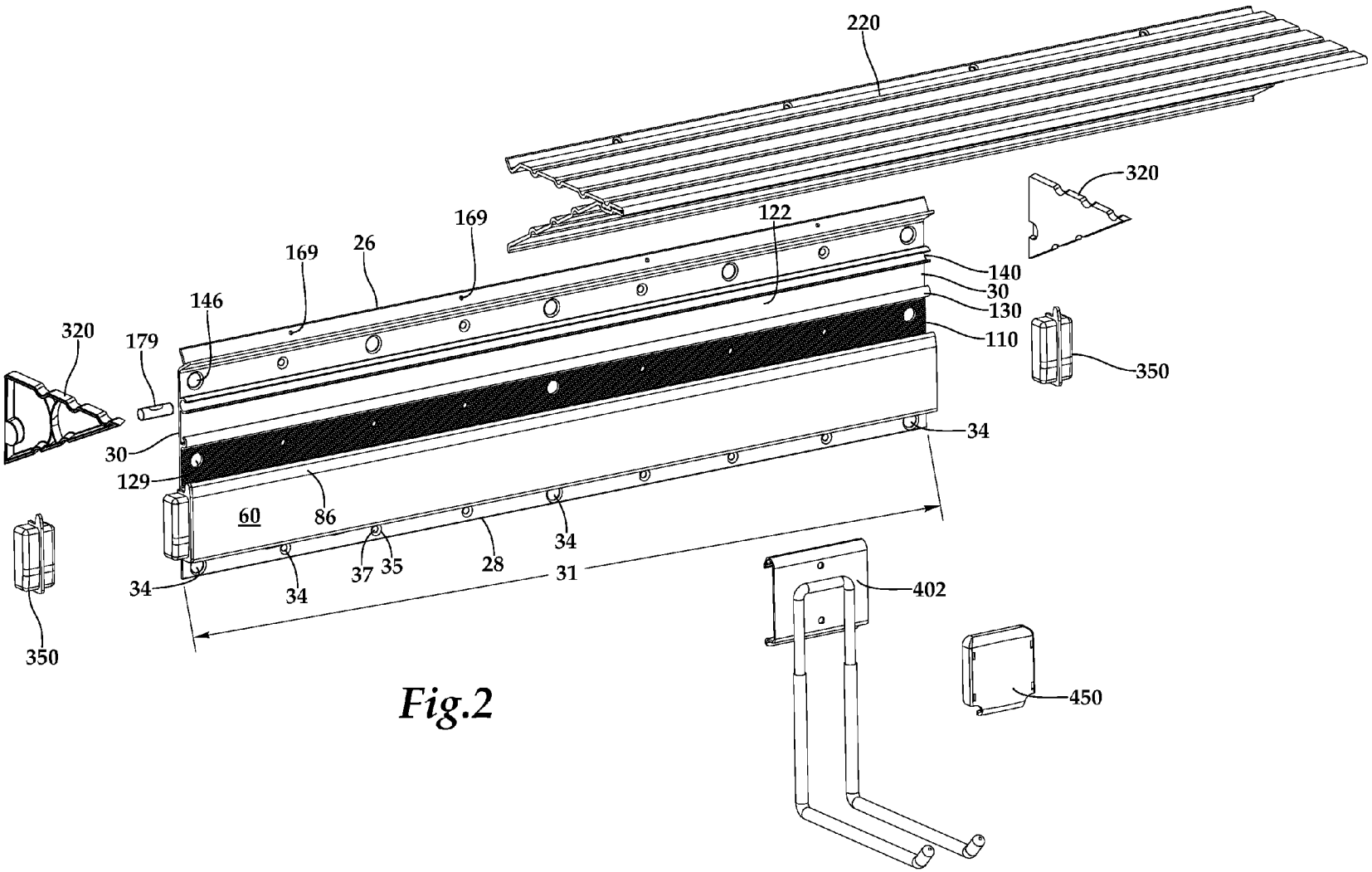
FIG. 2 is an exploded view of the storage system of FIG. 1A.

Rail storage system 10 is mountable to a wall, mounting surface or substrate such as drywall with at least one fastener and system 10 is used for holding, typically hanging, objects (not shown), such as a tool, a rake, a ladder or the like. Referring to FIGS. 1 and 2, rail storage system 10 may include base or rail 20 and at least one accessory 400. As shown in FIGS. 1 and 2, system 10 further may include a shelf 200, a cover 250, an upper endcap 300 and/or a lower endcap or connector 350. As shown in FIG. 1C, system 10 may be coupled to one or more additional systems 10.

Base

Figure 3:
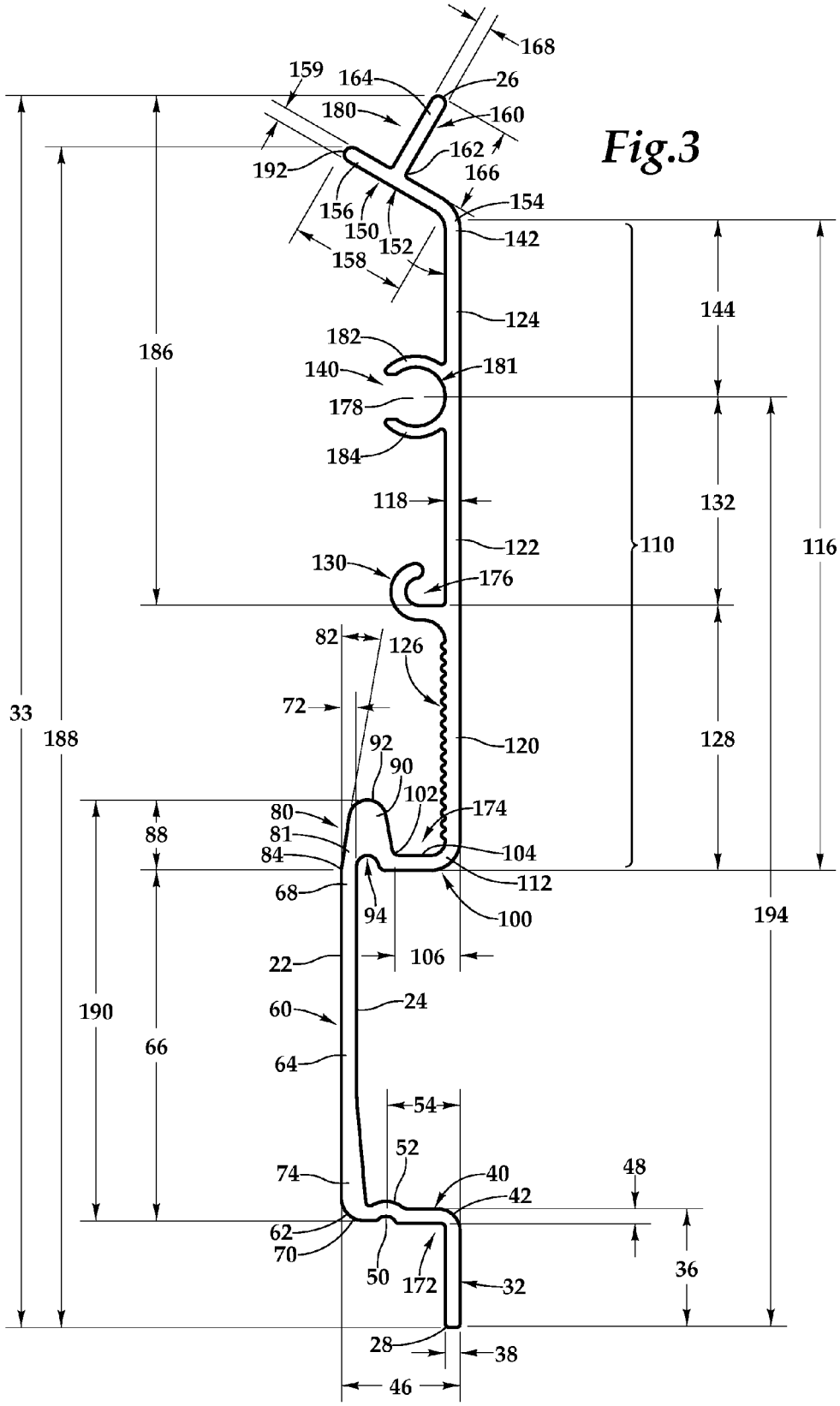
FIG. 3 is a side view of one embodiment of a rail.

Referring to FIGS. 1-3, a storage system 10 may include a base or rail 20 having a front surface 22, a rear surface 24, a top or upper edge 26, a bottom or lower edge 28 and sides 30. Base 20 further may have a plurality of portions, such as portions 32, 40, 60, 80, 100, 110, 150 and 160. In one embodiment, as shown in FIG. 3, each portion 32, 40, 60, 80, 100, 110, 150 and 160 extends along entire length 31 of base 30. In another embodiment, each portion 32, 40, 60, 80, 100, 110, 150 and 160 extends along only a portion of length 31 of base 30. In one embodiment, base 20 is unitarily formed. In alternative embodiments, base 20 may be fabricated as a plurality of members or portions that are coupled together. Base 20 may have an overall height 33 that may be between about 1" and about 18", preferably between about 4" and about 12", and in one embodiment, about 6.5". Alternatively, base 20 may have any height 33 that facilitates use and/or operation of base 20 with system 10.

As shown in FIG. 3, a first or lower wall engaging portion 32 may be configured to engage a portion of a wall, such that rear surface 24 of portion 32 may abut or engage a portion of a wall. In one embodiment, portion 32 and wall may be substantially parallel or flush with respect to one another, when portion 32 and wall contact one another. Turning to FIG. 2, wall engaging portion 32 may include a plurality of openings 34 such that a fastener may be inserted through each opening to engage a wall or surface. Each opening 34 may have an ingress 35 within front surface 22 and an egress 37 within rear surface 24. In one embodiment, the ingress may have a diameter that is different than a diameter of the egress. For example, the ingress diameter may be larger than the egress diameter to engage a head of a fastener. In another embodiment, each opening 34 may have a constant diameter between surfaces 22, 24. Moreover, openings 34 may have diameters of varying size.

Returning to FIG. 3, portion 32 may have a height 36 and a generally constant thickness 38. In one embodiment, height 36 is sized such that an opening 34 within portion 32 is sized to receive a fastener, such as a fastener sold under the trademark Tornado®, see commonly assigned patent application Ser. No. 11/832,311 to Ernst, et al. These fasteners are preferred because the fasteners enable system 10 to be mounted anywhere in a wall or mounting surface. Height 36 may be between about 0.25" and about 4", preferably between about 0.5" and about 3", and in one embodiment, about 1.5".

Continuing with FIG. 3, base 20 further may include a second or lower extension portion 40. In one embodiment, lower extension portion 40 is substantially normal via a bend 42 to lower wall engaging portion 32 and extends outwardly therefrom, and further has a straight part 44 with a width 46. Width 46 may be between about 0.05" and about 2", preferably between about 0.1" and about 0.75", and in one embodiment, about 0.63". Also in one embodiment, portion 40 has a thickness 48, wherein thickness 48 is substantially constant. Further, in one embodiment, thickness 48 maybe the same as thickness 38. Portion 40 also may include an indentation 50 configured to engage or interface with accessory 400. In one embodiment, indentation 50 is formed within front surface 22 of portion 32. Indentation 50 may be positioned a distance 54 from portion 32 and may have a radius of curvature 52.

Base 20 also may include a third portion or protrusion 60 configured to engage or interface with a base plate 402 of at least one accessory 400. In one embodiment, protrusion 60 is substantially normal via a bend 62 to lower extension portion 40 and extends upwardly therefrom, and further has a straight part 64 with a height 66 that extends between a top or upper edge 68 and a bottom or lower edge 70. Height 66 may be between about 0.25" and about 7", preferably between about 0.5" and about 5", and in one embodiment, about 2". In one embodiment, height 66 is more than three times height 36. Protrusion 60 may be substantially parallel to portions 32 and/or a wall or mounting surface.

Protrusion 60 has a thickness 72 and, in one embodiment, thickness 72 varies between top 68 and bottom 70. For example, thickness 72 may be greater proximate bottom 70 than proximate top 68. In one embodiment where thickness 72 is greater proximate bottom 70, rear surface 24 of thicker portion 74 may form an obtuse angle with rear surface 24 of straight part 64. Moreover, in one embodiment, thickness 72 may be about 1.5 times thicker proximate bottom 70 than proximate top 68.

Continuing with FIG. 3, base 20 may include a fourth or upper accessory engaging portion 80 that may be configured to receive, interface with or engage accessory 400. In one embodiment, portion 80 has a part 81 having a length 88 that is angled upwardly and inwardly at an angle 82 via a bend 84 with respect to straight part 64 of portion 60, and portion 80 has a part 90 that is angled downwardly and outwardly via a bend 92 with respect to part 81. Part 90 may also have a length 88. Angle 82 may be between about 5 degrees and about 50 degrees, preferably between about of about 10 degrees and 40 degrees, and in one embodiment, about 30 degrees, and length 88 may be between about 0.05" and about 2", preferably between about 0.1" and about 1", and in one embodiment, about 0.2" or about ¼". In one embodiment, portion 80 further includes a part 90 that is angled downwardly and slightly outwardly via a bend 92 with respect to part 81 with length 88.

In one embodiment, portion 80 includes an indentation 94 formed in rear surface 24. Indentation 94 may have a radius of curvature and may be vertically offset from indentation 50. For example, indentation 94 may be a greater distance from a wall or substrate than indentation 50. For another example, indentation 94 may be a greater distance from lower wall engaging portion 32 than indentation 50. The offset may provide stability and strength during use and manufacturing of base 20 and/or system 10.

Base 20 also may include a fifth or upper extension portion 100. Portions 40 and 100 enable portion 60 to be positioned a distance from wall or substrate and, in one embodiment, portions 40 and 100 are substantially parallel to one another and/or are substantially normal to wall or mounting surface. In one embodiment, upper extension portion 100 is substantially normal via a bend 102 to part 90 of portion 80 and extends outwardly therefrom, and has a straight part 104 with a width 106. Width 106 may be less than width 46, and width 106 may be between about 0.05" and about 2", preferably between about 0.1" and about 0.75", and in one embodiment, about 0.5". Also, in one embodiment, portion 40 has a substantially constant thickness 108, wherein thickness 108 may be substantially the same as thickness 38 and 48.

Continuing further with FIG. 3, base 20 may include a sixth or upper wall engaging portion 110. Portion 110 may be configured to engage a portion of a wall, such that rear surface 24 of portion 110 may abut or engage a portion of a wall. In one embodiment, portion 110 is substantially parallel to portions 60 and/or portion 32 and/or wall. In one embodiment, portion 110 is substantially normal via a bend 112 to portion 100 and extends upwardly therefrom, and further has a straight part with a length 116. Height 116 may be greater than height 66, and height 116 may be between about 1" and about 16", preferably between about 3" and about 12", and in one embodiment, about 4". Also in one embodiment, portion 40 has a thickness 118 that is substantially constant, wherein thickness 118 may be substantially the same as thickness 38 and 48.

Portion 110 may include three parts, such as a lower part 120, a middle part 122 and an upper part 124. Lower part 120 may be defined between portion 100 and a projection or extension 130, described below, and lower part 120 may include a plurality to teeth or ridges 126 defined within front surface 22. In another embodiment, lower part 120 does not include teeth 126 and may have a generally planar front surface 22. Ridges 126 may strengthen part 120 and base 20.

As shown in FIG. 2, in one embodiment, lower part 120 includes a plurality of openings 129 such that a fastener may be inserted through each opening to engage a wall or mounting surface. In one embodiment, openings 129 have diameters of varying sizes. Further, in one embodiment, openings 129 may be substantially similar to openings 34. Portion 110, similar to portion 32, may have a height 128 and a generally constant thickness. In one embodiment, height 128 is sized such that an opening 129 within portion 110 is sized to receive a fastener therein. Again, these fasteners are preferred because the fasteners enable system 10 to be mounted anywhere in a wall or mounting surface. Height 128 may be between about 0.25" and about 4", preferably between about 0.5" and about 3", and in one embodiment, about 1.5".

Middle part 122 may be defined between projection 130 and a projection 140, described in greater detail below, and middle part 122 may have a height 132 that may be between about 0.25" and about 4", preferably between about 0.5" and about 3", and in one embodiment, about 1.5". As shown in FIG. 3, in one embodiment, lengths 128, 132 are substantially the same. Surfaces 22, 24 of middle part 22 may be generally planar.

Upper part 124 may be defined between projection 140 and a top edge 142 of portion 110. Upper part 124 may have a height 144 that may be between about 0.25" and about 4", preferably between about 0.5" and about 3", and in one embodiment, about 1.5". As shown in FIG. 2, in one embodiment, upper part 124 includes a plurality of openings 146, wherein openings 146 may be configured to receive fasteners therein. Further, in one embodiment, openings 146 have diameters of varying sizes. In one embodiment, openings 146 may be substantially similar to openings 129 and/or openings 34. Further, surfaces 22, 24 of upper part 124 may be generally planar.

Continuing with FIG. 3, a seventh portion or projection 150 may be configured to engage a portion of a shelf 200, described in more detail herein. In one embodiment, portion 150 extends outwardly and upwardly at an angle 152 via a bend 154 with respect to portion 110 and further has a straight part 156 with a length 158. In one embodiment, portion 150 extends outward and upward from top edge 142 of portion 110. Angle 152 may be between about 100 degrees and about 175 degrees, preferably between about of about 120 degrees and 150 degrees, and in one embodiment, about 135 degrees, and length 158 may be between about 0.1" and about 2", preferably between about 0.25" and about 1", and in one embodiment, about 0.5". Further, length 158 may be slightly greater than width 46 and/or width 106. In one embodiment, height 144 may be substantially the same as height 36 of portion 32. Also in one embodiment, portion 150 has a substantially constant thickness 159 with generally planar surfaces 22, 24.

An eighth portion or projection 160 also may be configured to engage a portion of a cover or shelf 200. Portion 160 and/or top edge 26 may abut the wall or mounting surface. In one embodiment, portion 160 is substantially normal via a bend 162 to portion 150 and extends outwardly therefrom, and further has a straight part 164 with a length 166. Length 166 may be between about 0.1" and about 2", preferably between about 0.25" and about 1", and in one embodiment, about 0.5". Also in one embodiment, length 166 may be substantially the same as height 144. Portion 160 may extend from the middle of rear surface 24, and portion 160 may have a substantially constant thickness 168. In one embodiment, thickness 168 is substantially the same as thickness 159. Moreover, a plurality of openings 169 may be defined within portion 160, wherein openings 169 may be configured to receive fasteners therein. In one embodiment, openings 169 may have diameters of substantially the same size.

Further continuing with FIG. 3, front surface 22 further may comprise a plurality of tracks, grooves, ledges or channels 170, 172, 174, 176, 178 and 180. In one embodiment, front surface may comprise five generally parallel channels 170, 172, 174, 176, 178 and 180, wherein the channels may extend substantially along the length 31, defined between sides 30, of base 20. In addition, each channel 170, 172, 174, 176, 178 and 180 may be shaped differently, and may have different purposes as described below.

A first, or bottom accessory channel 172, may be proximate bottom 28 of base 20. In one embodiment, channel 172 is defined by surface 22 of portion 32 and surface 22 of portion 40. Bottom channel 172 may interface with an accessory or accessories 400. Moreover, bottom channel 172 may include indentation 50 in front surface 22 of portion 40 to facilitate interfacing and/or retaining an accessory or accessories 400 with base 20. Channel 172 may assist in preventing vertical motion of accessory or accessories 400 and/or preventing motion in a direction other than generally along a length of channel 172.

A second or upper accessory channel 174 may be formed generally by portions 80, 100, 110 and may be configured to interface with an accessory 400. As part 81 of portion 80 has an incline or angle 82, the incline may increase the contact surface area between surface 24 and accessories 400, increasing holding strength and creating greater stability for system 10. Incline may also make it more difficult for accessories to become dislodged when a load is applied to or removed from accessory 400.

Channel 174 may increase the shear component of the force exerted by an object suspended from accessory 400 and, thereby, reduce the bending moment exerted by the object on system 10 and on accessories 400 holding storage system 10 to a wall or mounting surface. This may be accomplished through one or more structural considerations that decrease the distance between the wall or mounting surface and rear side of channel 174, i.e., surface 22 of portion 60, and/or decrease the distance between the wall or surface and forward side of channel 174, i.e., surface 22 of portion 110. In addition, rear surface 24 may be generally flush with the wall or mounting surface. Moreover, surface 22 of portion 60 may be spaced a predetermined distance from surface 22 of portion 110.

Base 20 further may comprise projection 130 extending outwardly from base 20. Projection 130 may form a third channel 176 that is spaced from channel 174. In one embodiment, projection 130 extends outward from surface 22 and is configured to engage or interface with a portion of a cover or shelf. Channel 174 may be generally circular in shape. Moreover, in one embodiment, channel 174 is an upwardly shaped hook. Projection 130 is a distance above portion 100 such that when accessories 400 are coupled to base 20, accessories 400 and projection 130 do not interfere with one another. Further, projection 130 may extend outward from mounting surface less than the distance or width 106 of portion 110 so as to allow for easier insertion of accessories 400 into channel 174.

Base 20 may further comprise a projection 140 spaced from projection 130. In one embodiment, projection 140 is a c-shaped projection, such that an arcuate top portion 182 is downturned towards an arcuate bottom portion 184 and lower portion 184 is upwardturned towards top portion 182 with a space therebetween. Top portion 182 and a bottom portion 184 may form a fourth channel 178. Channel 178 may be generally circular in shape and may have a radius of curvature 181. Channel 178 may be configured to receive a level therein. A level 179, such as an integrated bubble level, may be located within channel 178, wherein level 179 may slide within channel 179 for installation. The level may be positioned, for example, behind a cover or shelf 200 so as to be concealed after installation or final assembly.

A fifth channel 180 may be defined by portions 150 and 160 and may be configured to receive a portion of a cover or shelf 200.

Continuing with FIG. 3, length 31 may be between about 12 inches and about 36 inches, preferably between about 14 inches and about 30 inches, still more preferably between about 16 inches and about 24 inches. Base 20 may have a height 186 defined between edge 26 and projection 130. Height 186 may be between about 0.1" and about 4", preferably between about 1" and about 3", and in one embodiment, about 2.67". Base 20 further may have a height 188 defined between an edge 192 and edge 28. Height 188 may be between about 1" and about 18", preferably between about 4" and about 12", and in one embodiment, about 6.262". Moreover, base 20 may have a height 190 defined between top of bend 92 and portion 40. Height 190 may be between about 0.25" and about 8", preferably between about 1" and about 6", and in one embodiment, about 2.25". Further, base 20 may have a height 194 defined between projection 140 and portion 100. Height 194 may be between about 1" and about 10", preferably between about 2" and about 8", and in one embodiment, about 4.94".

Continuing further with FIG. 3, base 20 may be comprised of a thin, relatively strong material to withstand repeated loading and unloading of accessories 400 or covers or shelves and loads supported by accessories 400 or shelves. Base 20 may be made of steel, plastic, extruded aluminum, or one or more other suitable materials. In one embodiment, base 20 is made of rolled steel and may be of unitary construction. In another embodiment, base 20 is made of a plurality of pieces operatively connected to one another, such as by welding, riveting or through other means. Portions 32, 60 and 110 of base 20 may be generally parallel to one another and/or generally parallel to a wall or mounting surface. As can be seen in FIGS. 2 and 3, rear surface 24 of base 20 may have a plurality of generally planar surfaces such that base may lay generally flush against mounting surface (not shown) when installed in order to minimize the distance that base 20 extends from mounting surface and to increase shear component of loading, thereby increasing system 10 holding strength.

Turns in steel may have radii of curvature, such as at the identified bends, so as to prevent the formation of stress concentrations or other areas of weakness. In one embodiment, radii of curvature are generally similar throughout turns of base 20.

Base 20, 101 and/or 151 may be coupled to a wall or mounting surface with a plurality of fasteners. In the embodiment, shown in FIG. 2 and as mentioned herein, each of openings 34, 129, 146 and 169 is configured to admit a fastener having a crest diameter of at least about ¼ inch, preferably at least about ½ inch. For example, fasteners may resemble those disclosed in the commonly assigned patent application Ser. No. 11/832,311 to Ernst, et al., the contents of which are incorporated by reference herein, so that fasteners may be used to install system without regard for the location of support members behind wall or the mounting surface. In another example, fasteners may be any type of fastener, such as fasteners sold under the trademark Tapcon®, also commonly assigned. In yet a further example, fasteners may be any fastening means, such as a screw, that is suitable to mount system 10.

Each fastener may include a head having a recess, such as a Phillips recess, for receiving a rotary driver so that system may be installed with a driving tool, such as a screwdriver or a drill with a screwdriver bit. Recess includes one or more torque transmitting surfaces so that torque may be transmitted from the rotary driver to rotate the fastener in order to drive the fastener through the wall.

In one embodiment, the openings, such as openings 34, 129, 146, in base 20 may be sized slightly larger than major diameter of fasteners so as to allow free passage of fasteners during installation. In another embodiment, the openings 34, 129, 146 and 169 may have any size and may be configured to receive a fastener therein.

In one embodiment, the openings, such as openings 169, in base 20 may be sized slightly smaller than major diameter of fasteners so as to meter fastener during installation. In addition, the openings in base 20 may be sized smaller than heads of fasteners so that each head engages base 20 and/or cover 250 and/or shelf 200, 220 around the opening.

When the fastener is inserted through openings, such as openings 169, to couple a fixture, such as base 20 and/or cover 250 and/or shelf 200, 220, to a wall or mounting surface, so long as the fastener, and preferably the threads of the fastener, remains engaged with and/or under the control of the fixture, the fastener will not be stripped out from the wall, either by rotation or translation of the fastener. The engagement of the fastener (preferably the threads) with the fixture, along with inserting the fastener downwardly into the wall at an angle, preferably at about a 45 degree angle, prevents the fastener from stripping. Fastener angling may be accomplished by angling portion 160 and/or opening 169 with respect to the wall or mounting surface. Additionally, the fastener, when engaged with the fixture, has significant holding strength in holding the fixture to the wall.

Each set of openings 34, 129, 146 and 169 may have generally collinear centers to install fasteners along a common line. However, the openings may be horizontally offset from one another, staggered, or in any other configuration. For example, openings 34 defined within portion 32 may have generally collinear centers to install fasteners along a common line; however, openings 34 may be offset from one another. Openings 34, 129, 146 and 169 may be spaced equidistantly, for example, about every 6 inches. It is contemplated that system 10 installed using fasteners as described above may have a holding strength of at least about 500 lbs of weight.

System 10 allows a user to select a position anywhere on a wall or mountable substrate that is feasible to place the object desired to be held. System 10 may be used for holding tools or other objects on interior or exterior walls or mountable substrates of a residential home and is particularly useful for hanging tools or other objects from a wall or ceiling within a garage. However, system 10 may be equally usable in other applications.

The wall or mounting surface (not shown) may be one of several materials used in construction, such as stucco, plaster, or gypsum based drywall sold under the trademark SHEETROCK by United States Gypsum. Drywall typically has a thickness T of about ½ inch or about ⅝ inch, but it may be obtained in other thicknesses, such as about ⅜ inch. Typically, friable substrates such as drywall are mounted to support studs, such as wood support studs, for example 2×4 studs or the like, evenly spaced apart, e.g. every 16 inches, or metal support studs, such as steel support studs. Studs are substantially more resistant to pullout than drywall because they are less friable and much less likely to break apart, but it may be harder to drive fasteners into studs.

Figure 4:
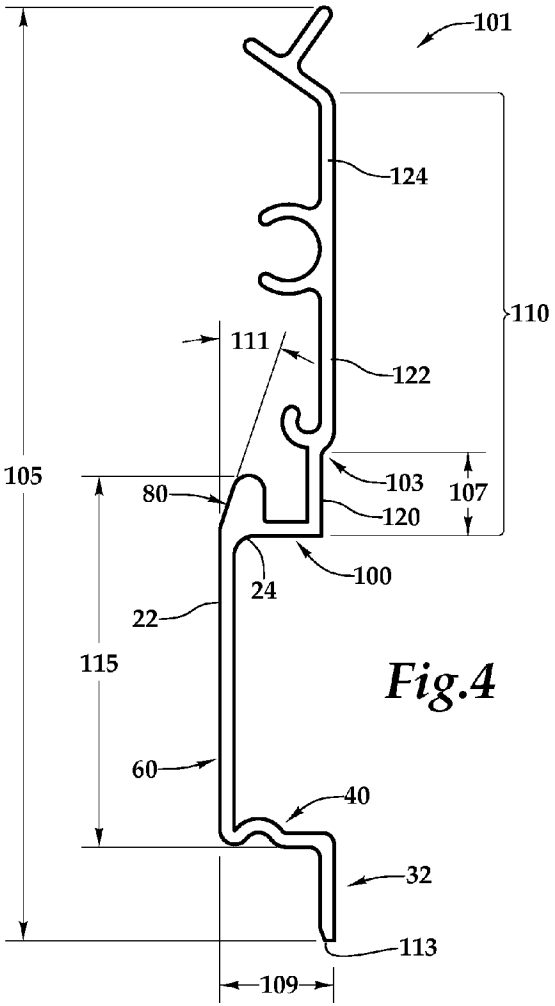
FIG. 4 is a side view of another embodiment of a rail.

FIG. 4 shows a base 101 that may be used with system 10. Base 101 is similar to base 20; however, instead of having a generally planar rear surface 24 of portion 110, base 101 has a step 103 in rear surface 24 of portion 110. Step 103 may be positioned proximate or just below projection 130. Moreover, overall height 105 of base 101 may be less than the overall height 33 of base 20, and height 107 of base 101 may be less than height 128 of base 20; however, in one embodiment, height 115 of base 101 may be substantially the same as height 190 of base 20. For example, height 115 may be between about 1" and about 9", preferably between about 3" and about 8", and in one embodiment, about 5.64". Also, a width 109 of base 101 may be greater than width 46 of base 20. Further, base 101 may not have an indentation 94; rather, base 101 may have a substantially planar rear surface 24 of portions 80, 100. Additionally, surface 22 of part 120 of base 101 may not include teeth 126 such that it may be generally planar. Also, an angle 111 of portion 80 of base 101 may be greater than angle 82 of portion 80 of base 20. Moreover, an end 113 of portion 32 of base 101 may have a slightly angled end, as compared to end 28 of portion 32 of base 101 that may be substantially rectangular.

Figure 5:
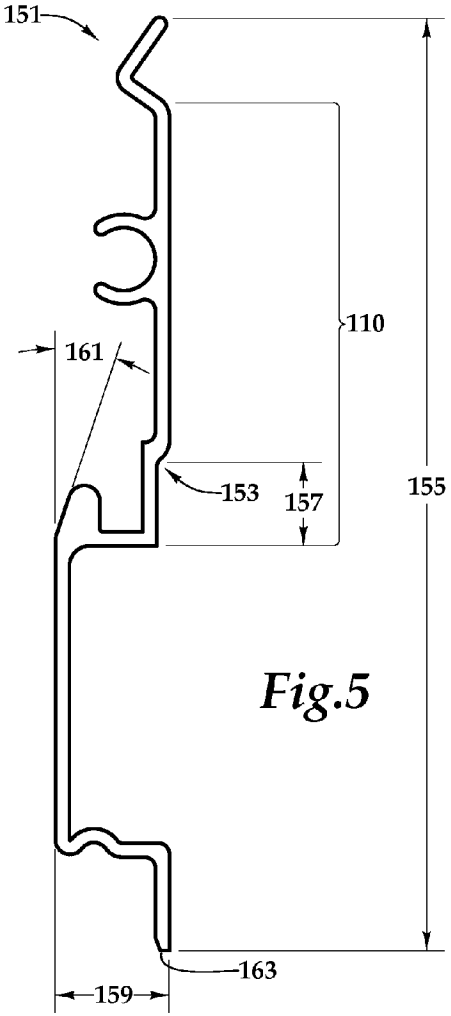
FIG. 5 is a side view of yet another embodiment of a rail.

FIG. 5 shows a base 151 that may be used with system 10. Base 151 is similar to base 20; however, instead of having a generally planar rear surface 24 of portion 110, base 151 has a step 153 in rear surface 24 of portion 110. In further comparison to base 20, base 151 does not include projection 130. Moreover, the overall height 155 of base 151 may be less than the overall height 33 of base 20, and height 157 of base 151 may be less than height 128 of base 20. For example, height 155 may be between about 1" and about 9", preferably between about 3" and about 8", and in one embodiment, about 5.66". Also, width 159 of base 151 may be greater than width 46 of base 20. Further, surface 22 of part 120 of base 151 may not include teeth 126 such that it may be generally planar. Also, angle 161 of portion 80 of base 101 may be greater than angle 82 of portion 80 of base 20. Moreover, end 163 of portion 32 of base 101 may have a slightly angled end, as compared to end 28 of portion 32 of base 101 that may be substantially rectangular. Furthermore, base 151 does not include portion 160.

Shelf

As shown in FIGS. 1, 1A, 1C and 2, system 10 also may comprise a shelf configured to couple to portion 110 of base 20 and may be configured to hold a plurality of objects, such as household tools or the like. In one embodiment, shelf is configured to couple to an upper portion/projection or portions/projections 110, 150 and/or 160 and may be configured to interface or engage projection 130 and projections 150, 160.

Figures 6, 7, 7A:
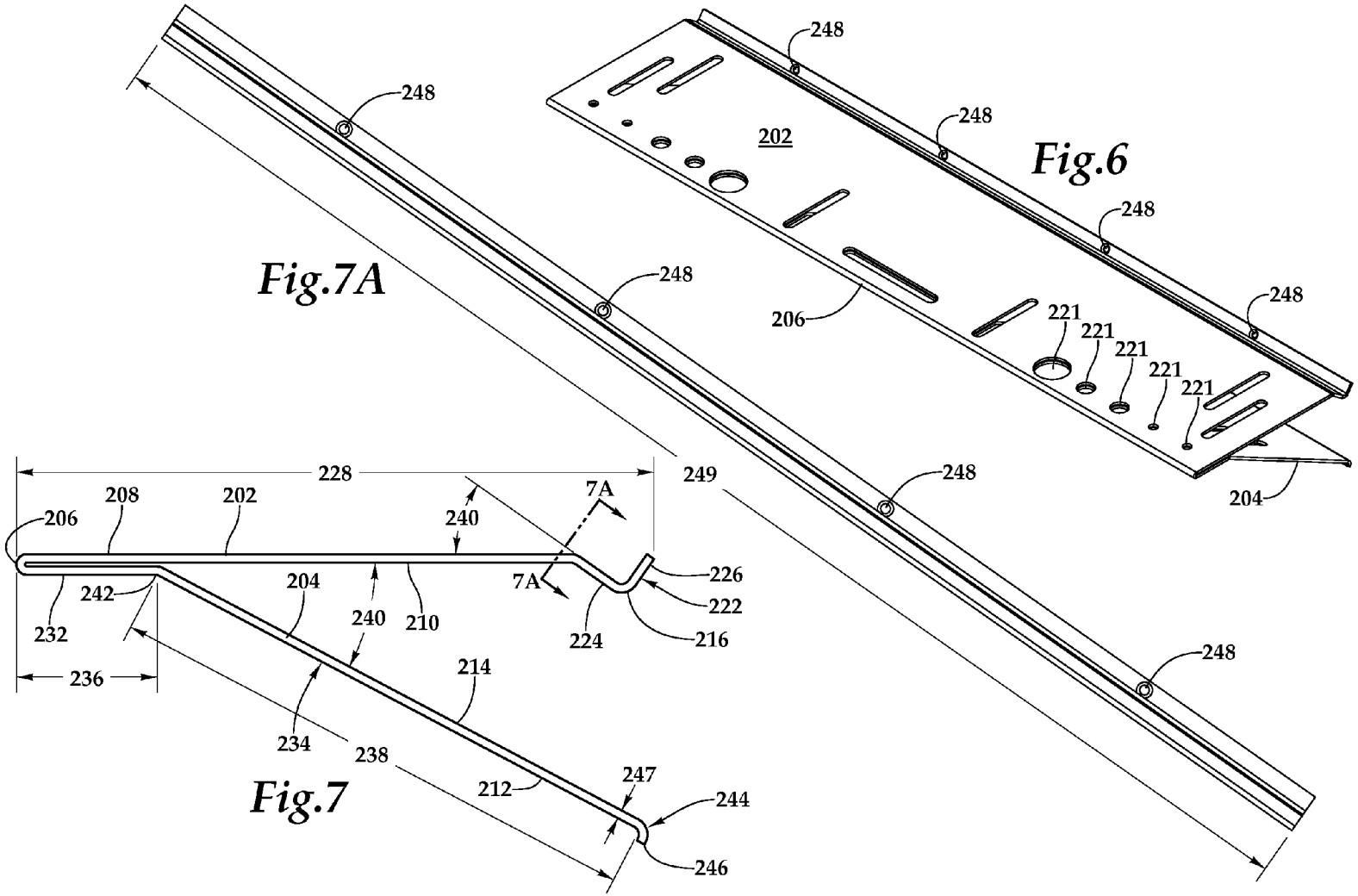
FIG. 6 is a perspective view of a shelf shown in FIG. 1.
FIG. 7 is a side view of the shelf of FIG. 6.
FIG. 7A is a cross-sectional view, taken along line A-A, of the shelf of FIG. 6.

As seen in FIGS. 1, 1C and 6, a shelf 200 may include a top portion 202 and a bottom portion 204 with a hinge 206 therebetween. Top portion 202 may include a plurality of slots and/or openings 221 of varying shapes and sizes that may be configured to receive items such as a tool, a hammer or other objects. Further, one or more items, such as tools, may be placed or laid on top portion 202 of shelf 200, when it is coupled to base 20, to store or hold additional items.

Turning to FIG. 7, top portion 202 has an outer surface 208 and an inner surface 210 and, similarly, bottom portion 204 has an outer surface 212 and an inner surface 214. Top portion 202 may include an indentation 216 that may be formed proximate an end 222 and may be configured to engage or interface with portions 150 and 160 of base 20. In one embodiment, indentation 216 has a v-shape that may include a first part 224 and a second part 226 and is sized to fit within channel 180 such that first part 224 may abut portion 150 and second part 226 may abut portion 160. First part 224 may have a length between about 0.1" and about 2", preferably between about 0.2" and about 1" and in one embodiment, about 0.614", and second part 226 may have a length between about 0.1" and about 2", preferably between about 0.2" and about 1" and in one embodiment, about 0.454".

As shown in FIG. 7A, a cross section of FIG. 7, second part 226 also may include a plurality of openings 248. In the embodiment shown in FIG. 7A, each opening 248 is configured to admit a fastener having a crest diameter of at least about ¼ inch. Also, in one embodiment, openings 248 are configured to be aligned with or concentric with openings 169 in portion 160.

Each fastener may include a head having a recess, such as a Phillips recess, for receiving a rotary driver so that system may be installed with a driving tool, such as a screwdriver or a drill with a screwdriver bit. The recess includes one or more torque transmitting surfaces so that torque may be transmitted from the rotary driver to rotate the fastener in order to drive the fastener through the wall.

The openings 248 may be sized slightly smaller than major diameter of fasteners so as to meter fastener during installation, such that the head of each fastener engages shelf 200 around opening 248 and such that the threads of the fastener engage shelf 200 to prevent stripping of the fastener. In one embodiment, each fastener is inserted through at least one opening 169 and/or at least one opening 248 at about a 45 degree angle to increase the holding strength in the wall.

Further, as shown in FIG. 7A, openings 248 may have generally collinear centers to install fasteners along a common line. However, the openings may be horizontally offset from one another, staggered, or in any other configuration. Openings 248 may be spaced equidistantly, for example, about every 6 inches.

Top portion 202 further may include a third substantially straight part 230 and a length 228 defined between hinge 206 and end 222. Length 228 may have a length between about 1" and about 8", preferably between about 3" and about 6" and in one embodiment, about 5.885".

Bottom portion 204 is configured to rotate or pivot about hinge 206 between an open position and a rotated position.

Bottom portion 204, in a rotated position, may engage or interface with top portion 202. In one embodiment, bottom portion 204 includes a first part may include two substantially straight parts 232 and 234. Straight part 232 has a length 236 that may be between about 0.1" and about 2", preferably between about 0.2" and about 1" and in one embodiment, about 1.32." Straight part 234 has a length 238 and, in a rotated position, is angled downwardly and outwardly at an angle 240 via a bend 242 with respect to straight part 232. Length 238 may be between about 1" and about 8", preferably between about 3" and about 6" and in one embodiment, about 5.157," and angle 240 may be between about 10 degrees and about 80 degrees, preferably between about 20 degrees and about 60 degrees, and in one embodiment, about 35 degrees. An end 244 of part 234 may include a generally downward facing lip 246 that is configured to engage projection 130 and/or channel 176. Lip 246 may extend downward a distance 247 that is between about 0.1" and about 3", preferably between about 0.2" and about 1" and in one embodiment, about 0.25".

In one embodiment, lip 246 is coupled to projection 130 and/or engages and/or is placed within channel 176, bottom portion 204 is rotated about hinge 206 until part 232 abuts at least a portion of part 230, and indentation 216 is coupled to portions 150 and/or 160 such that at least one fastener may be inserted through part 226 and portion 160 and into a wall, wherein parts 226 and portion 160 meter the fastener and/or prevent stripping of the fastener so long as the threads of the fastener remain engaged with parts 226 and/or portion 160.

Shelf 200 may have a length 249, such that length 249 may be between about 6" and about 48", preferably between about 12" and about 36" and in one embodiment, about 24". In one embodiment, length 249 is substantially the same as length 31 of base 20.

Continuing further with FIGS. 6, 7 and 7A, shelf 200 may be comprised of a thin, relatively strong material to withstand repeated loading and unloading of items, such as tools. Shelf 200 may be made of steel, plastic, or one or more other suitable materials. In one embodiment, shelf 200 is made of rolled steel and may be of unitary construction. In another embodiment, shelf 200 is made of a plurality of pieces operatively connected to one another, such as by welding, riveting or through other means.

As shown in FIGS. 1A, 2, 8 and 8A, shelf 220 is another embodiment of a shelf that may be used with system 10. In one embodiment, shelf 220 is fabricated from a plastic material that may be extruded; however, in alternative embodiments, shelf 220 may be fabricated from any suitable material.

Figure 8:
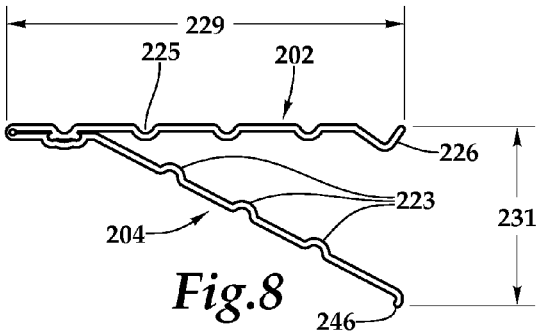
FIG. 8 is a side view of a shelf shown in FIG. 1A in a rotated position.

Shelf 220 is similar to shelf 200; however, shelf 220 is an extruded shelf having a plurality of extrusions or indentations 223 forming tracks 225 to provide slip resistance and/or a place to store items. In one embodiment, extrusions 223 are formed within outer surface 208 of top portion 202 and within outer surface 212 of bottom portion 204, such that extrusions 223 may extend inward. Further, in one embodiment, extrusions 223 may be arcuate. An extrusion 223 formed within portion 232 may be shaped to engage an extrusion 223 formed within portion 230, proximate hinge 206, when top portion 202 and bottom portion 204 are coupled together in a rotated position, as shown in FIG. 8.

Figure 8A:
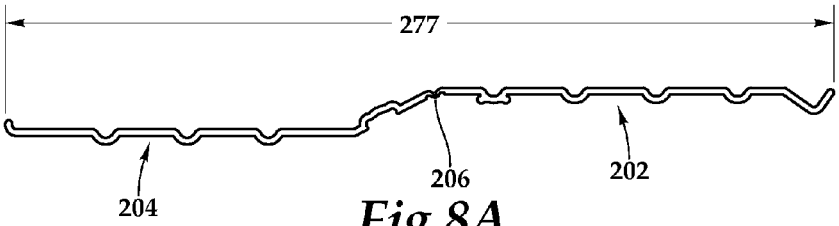
FIG. 8A is a side view of the shelf shown in FIG. 8 in an open position.

Continuing with FIG. 8A, shelf 220 may have a height 227 in an open position, such that height 227 may be between about 2" and about 24", preferably between about 4" and about 18" and in one embodiment, about 12.19". As compared to length 228 of portion 202 of shelf 200, portion 202 of shelf 220 may have a length 229. Length 229 may be between about 1" and about 12", preferably between about 2" and about 9" and in one embodiment, about 6". When in a rotated position, a distance 231 may be defined between ends 226, 246 of shelf 220. Distance 231 may be between about 0.5" and about 6", preferably between about 1" and about 4" and in one embodiment, about 2.630".

Cover

As seen in FIGS. 1-2, 9 and 9A, system 10 may further comprise cover 250 having an upper end 252, lower end 254, sides 256, front surface 258, and rear surface 259, such that cover 250 may conceal fasteners, openings and/or leveling means. In one embodiment, shown in FIG. 1B, cover 250 replaces shelf 200 or shelf 220. For example, cover 250 may replace shelf 200 or shelf 220 when objects held by an accessory 400 have a height that would interfere with the shelf 200 or when a shelf 200 is not needed or wanted when system 10 is assembled. In alternative embodiments, cover 250 may be used with shelf 200 or shelf 220.

Figure 9A:
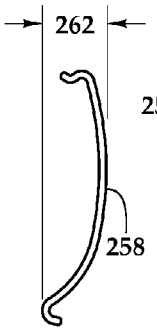
FIG. 9A is a side view of the cover shown in FIG. 9.
Figure 9:
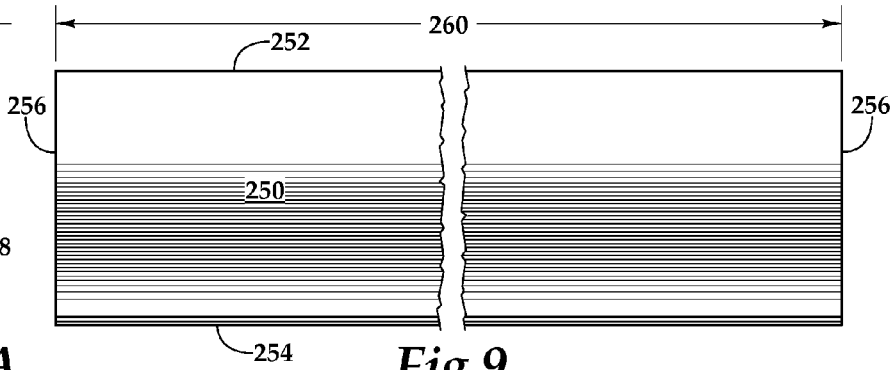
FIG. 9 is front view of a cover shown in FIG. 1B.

In one embodiment, as shown in FIG. 9, cover 250 is fabricated of a plastic material. Alternatively, cover 250 may be fabricated of steel or one or more other suitable materials. In one embodiment, cover 250 may include an image (not shown) printed or affixed thereon.

Upper end 252 of cover 250 may have a rearward upwardly extending curved tab 260 configured to engage or interface with outwardly extending portion 150 of base 20, and lower end 254 of cover 250 also may have a rearward downwardly extending tab 112 configured to engage projection 130 of base 20.

Continuing with FIG. 9A, surfaces 258, 259 may be arcuate surfaces, and, in one embodiment, surfaces 258, 259 may have a radius of curvature 260. Curvature 260 may be between about 1 and 6, preferably between 2 and 4, and in one embodiment, about 3.240. Moreover, cover 250 may have a length 260, height 261 and a width 262. Length 260 may be between about 12 inches and about 36 inches, preferably between about 14" and about 30", still more preferably between about 16" and about 24". In one embodiment, length 260 is substantially the same as length 31. Width 262 may be between about 0.1" and about 3", preferably between about 0.25" and about 2", and in one embodiment, about 0.63".

Endcaps

Figure 11:
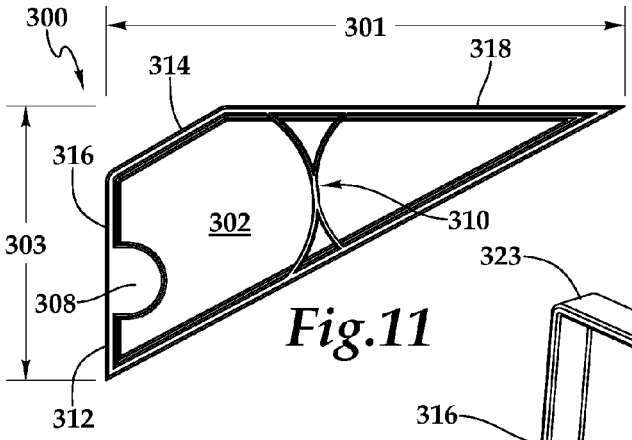
FIG. 11 is a side view of an endcap shown in FIG. 1.
Figure 11A:
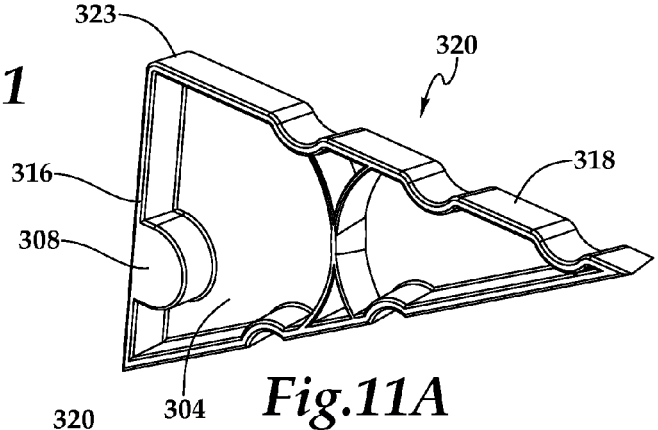
FIG. 11A is a left side view of an endcap shown in FIG. 2.
Figure 11B:
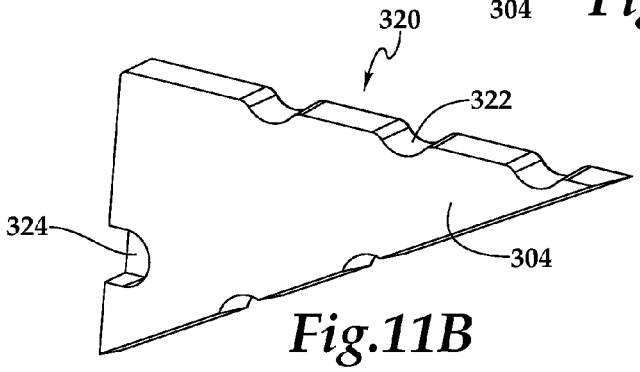
FIG. 11B is a right side view of an endcap shown in FIG. 2.

System 10 may further comprise one or more endcaps 300, 320, as shown in FIGS. 11, 11A and 11B, that may removably couple or attach to base 20 and/or shelf 200 and/or shelf 220. As seen in FIGS. 1, 1A, 1B, and 1C, sides 251 of shelf 200, in the rotated position, may have a generally triangular shape configured to receive upper end caps 300. End caps 300 are configured to add strength to system 10 and/or to improve the aesthetic of system 10.

Turning to FIG. 11, endcap 300 may have a generally triangular shape and may be sized to couple to side 251; however, endcap 300 may have any shape that facilitates coupling endcap to shelf 200, 220 and/or to base 20. In one embodiment, endcap 300 includes an angled surface 314 that extends between a top surface 318 and a rear surface 320.

End cap 300 may have a width 301 and a height 303. Width 301 may be between about 1" and about 6", preferably between about 2" and about 5", and in one embodiment, about 4.48", and height 303 may be between about 0.5" and about 4", preferably between about 2" and about 3", and in one embodiment, about 2.37".

Endcap 300 has an outer surface 302 that may be visible when endcap 300 is coupled to shelf 200 and/or to base 20. Outer surface 302 may include a projection 308. In one embodiment, projection 308 has an arcuate shape and is configured to couple or interface with projection 130. In one embodiment, rear surface 304 may have an opening 324 at the same location as where projection 308 is located in front surface 302.

Additionally, endcap 300 may include inward facing arcuately shaped projections 310. Projections 310 may have any shape that facilitates insertion and removal of endcap 300 with respect to shelf 200 and/or base 20. Endcap 300 further has an inner surface 304 that may be a generally planar surface. Alternatively, inner surface 304 may include one or more projections. For example, inner surface 304 may include projections similar to outer surface projections 308 and 310. A thickness may be defined between surfaces 302, 304, such that the thickness may be between about 0.1" and about 2", preferably between about 0.25" and about 1", and in one embodiment, about 0.38". Additionally, in one embodiment and seen in FIG. 11, end cap 300 may include a plurality of nibs 312.

In one embodiment, end cap 300 is fabricated from a plastic material that may be extruded; however, in alternative embodiments, end cap 300 may be fabricated from any suitable material.

When shelf 200 or 220 is in a rotated position and coupled to base 20, endcap 300 maybe removably attached to base 20 and/or shelf 200 and/or shelf 220, such that endcap 300 may act as a stop to prevent level 179 from sliding out of channel 178. Further, in this configuration, surface 318 may be configured to couple to or interface with portion 202 of shelf 200 or 220, surface 314 may be configured to couple or interface with indentation 216, and surface 316 may be configured to couple or interface with base 20.

Turning to FIGS. 11A and 11B, endcap 320 may be similar to endcap 300; however, endcap 300 is sized and shaped to facilitate removable attachment to shelf 200 and endcap 320 is sized and shaped to facilitate removable attachment to shelf 220. Moreover, in comparison to endcap 300, endcap 320 does not have a surface 314, rather surfaces 318 and 316 are in direct contact at bend 323. Also, endcap 320 does not have nibs 312, rather endcap 320 has indentations 322. Indentations 322 may be configured to interface with tracks 225 of shelf 220.

Connector

System 10 may further comprise one or more endcaps or connectors 350 removably attachable to base 20 and/or shelf 200 and/or shelf 220. As seen in at least FIGS. 1, 10, 10A and 10B, base 20, specifically portion 60, may have a generally rectangular shape configured to receive lower end caps or connectors 350. End caps 350 are configured to add strength to system 10 and/or facilitate coupling a first system 10 to a second system 10.

Figure 10:
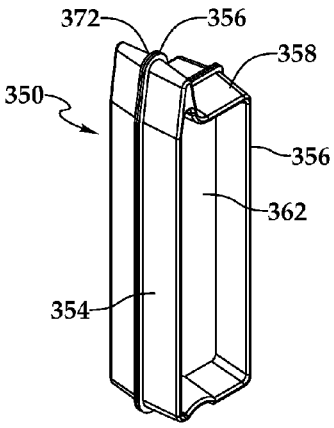
FIG. 10 is a perspective view of one embodiment of a connector.

Turning to FIG. 10, endcap 350 may have a generally rectangular shape and may be sized to couple to portion 60, wherein endcap 350 may have a lip 352 to limit the distance that endcap 350 can be inserted into portion 60. Alternatively, endcap 350 may have any shape that facilitates coupling endcap to base 20. In one embodiment, endcap 350 includes a front surface 354, rear surface 356, top surface 358, bottom surface 360 and side surfaces 362.

Endcap 350 has a height 364 defined by surfaces 354, 360, a width 366 defined by surfaces 354, 356, a thickness 368 defined by surfaces 362. Height 364 may be between about 0.5" and about 6", preferably between about 1" and about 3", and in one embodiment, about 1.75", width 366 may be between about 0.5" and about 4", preferably between about 0.75" and about 2", and in one embodiment, about 1", and thickness 368 may be between about 0.25" and about 2", preferably between about 0.5" and about 1", and in one embodiment, about 0.54".

Figure 10A:
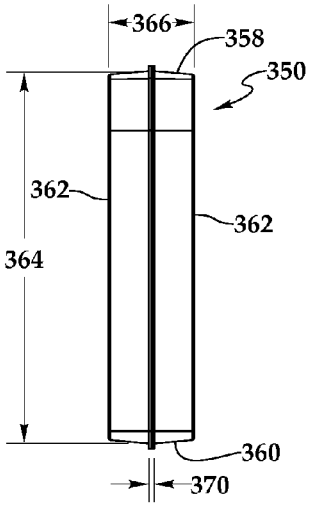
FIG. 10A is a front view of one embodiment of the connector shown in FIG. 10.
Figure 10B:
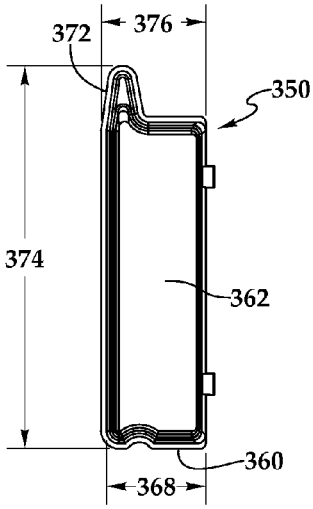
FIG. 10B is a side view of one embodiment of the connector shown in FIG. 10.

Continuing with FIGS. 10, 10A, and 10B, lip 352 may extend outwardly from surfaces 358, 354 and 360. In one embodiment, lip 352 is substantially equidistant between sides 362. Additionally, lip 352 may have a thickness 370. In one embodiment, thickness 370 is about 0.08". Lip 352 further may include a protruding portion 372. In one embodiment, protruding portion 372 is similarly shaped to portion 80 of base 20, such that portion 372 may interface with portion 80 when connector 350 is coupled to base 20. Lip 352 has a height 374 that may be greater than height 364, as height 374 includes the additional height of portion 372. A thickness 376 may be defined as the thickness of connector 350, including the additional thickness of lip 352, and may be between about 0.4" and about 2.5", preferably between about 0.55 and about 1", and in one embodiment, about 0.63".

In one embodiment, end cap 350 is fabricated from a plastic material that may be extruded; however, in alternative embodiments, end cap 350 may be fabricated from any suitable material.

While units may be self-contained such that a user can locate system at a desired location on mounting surface, a plurality of system 10 units may be joined or abutted to extend system 10. Sides 30 of base 20 may be manufactured at a substantially equivalent angle so that a plurality of bases 20 may abut when placed side-by-side. In one embodiment, side 30 is generally straight such that sides 30 are generally vertical when mounted on a wall. Endcaps 300 and/or 350 may be used with a single system 10 or a plurality of systems 10. When endcaps 300 and/or 350 are used with a plurality of systems 10, endcaps 300 and/or 350 strengthen the connection between the systems and aid in aligning the systems with respect to one another and/or make system 10 more aesthetically pleasing. Although endcaps 300 and/or 350 may be used with multiple systems, endcaps 300 and/or 350 may be removable prior to coupling systems 10 together. For example, if endcaps 300 and/or 350 are removed, system 10 may have a different type of connection, such as a friction fit, tongue and channel connections, tabs with mating recesses, etc.

Accessories 400

System 10 may further include one or more of a variety of accessories 400, such as hooks, receptacle, bins, magnetic strips, lights and/or the like, that may couple to and be spaced along a length of base 20. In one embodiment, accessories 400 are coupled to portion 60 of a base, such as base 20, and/or a shelf, such as shelf 200 or 220. In another embodiment, accessories 400 may be coupled directly to a wall or mounting surface with at least one fastener.

Accessories 400 may come in a variety of configurations to perform a variety of functions. For example, some hooks may be a long or short straight-sided hook, a long or short deep straight-sided hook, a straight or curved-sided single hook for use, for example, in holding a hose, a straight-sided curved hook or a paper towel holder, and some bins may be wide and some may be narrow.

Figure 1A:
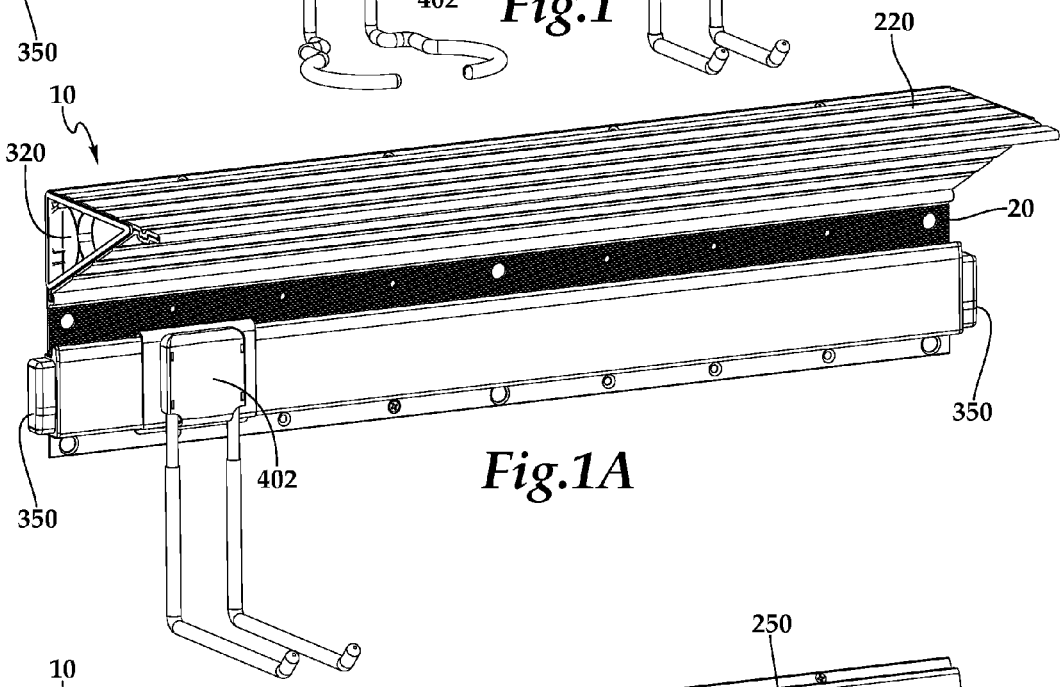
FIG. 1A is a perspective view of another embodiment of a storage system mountable to a wall.
Figure 1B:
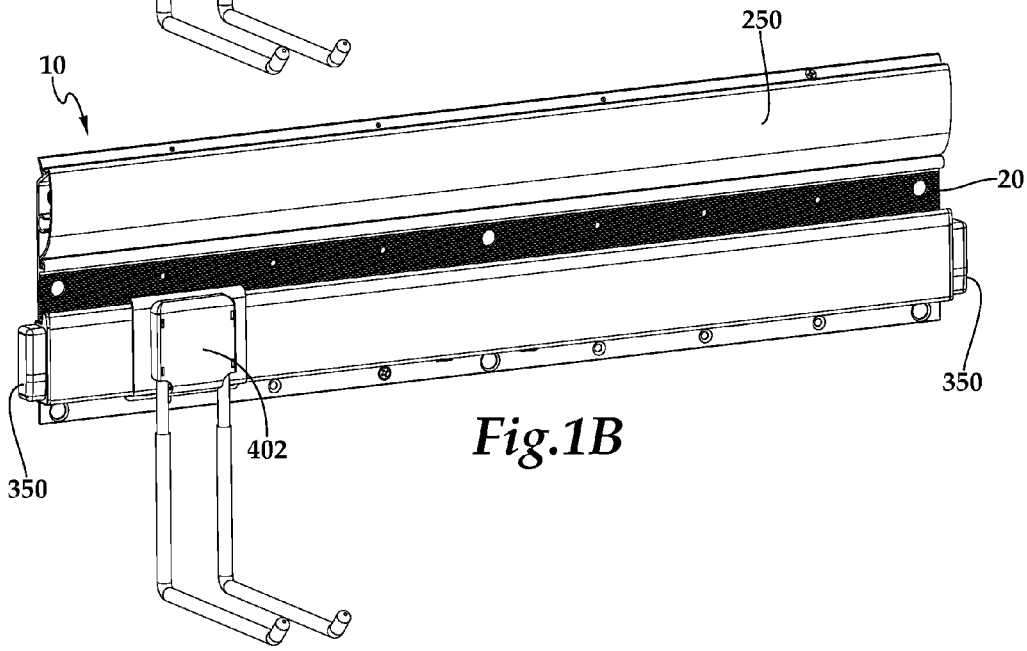
FIG. 1B is a perspective view of yet another embodiment of a storage system mountable to a wall.

As shown in at least FIGS. 1A and 1B, an accessory 400 may include a flat, generally planar, base plate or mounting plate or accessory plate 402.

Base plate 402 may be made of sheet metal having an outer surface 403 and an inner surface 405. In one embodiment, base plate 402 may have a thickness between about 10 gauge and about 20 gauge, preferably between about 14 gauge and about 18 gauge, more preferably about 16 gauge. Alternatively, base plate 402 is made of any suitable material to facilitate operation and utility of accessory 400. Base plate 402 may be stamped from sheet metal in a generally rectangular shape that may be between about 0.5" and about 5" tall from a top 410 to a bottom 412, preferably between about 1" and about 4", more preferably about 2". Base plate 402 may also be between about 0.5" and about 5" wide, preferably between about 1" and about 4", and in one embodiment, about 2" inch. In another embodiment, base plate 402 is made of a plastic material.

Base plate 402 may further have a plurality of openings 414 stamped out of plate 402 to enable accessory 400 to be mounted to a variety of surfaces. Openings 414 may be sized to accommodate fasteners and may have a diameter between about ¼" and about ¾" and, in one embodiment, about 0.188". Openings 414 may be substantially symmetrically formed about a center 420 of base plate 402. Openings 414 may be positioned at a predetermined distance 416 apart. In one embodiment, as shown in FIG. 13, distance 416 may be positioned between about 0.5" inch and about 6", preferably between about 1" and about 4" inch and, in one embodiment, about 1.5" or 1.550" apart.

Figure 13B:
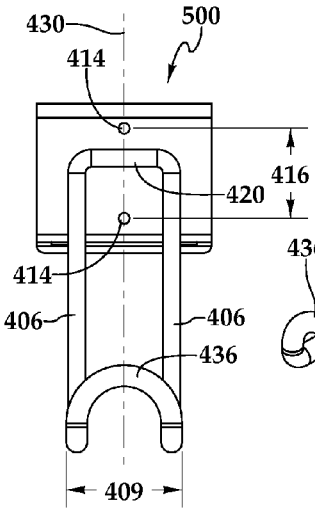
FIG. 13B is a front view of the hook of FIG. 13.

Base plate 402 also may include tabs or flanges that are configured to engage a base, such as base 20. In one embodiment, base plate 402 includes two tabs, an upper tab 422 extending outward and downward from surface 405 proximate top 410 and a lower tab 424 extending outward and downward from surface 405 proximate bottom 412, as shown in FIG. 13A. For example, upper tab 422 may have a hook shape configured to engage portion 80. In one embodiment, upper tab 422 is shaped and sized substantially similar to portion 80 such that tab 422 may engage or interface with portion 80, and lower tab 424 is shaped and sized substantially similar to channel 172 such that tab 424 may engage or interface with portions 32 and 40 of base 20. Tabs 422 and 424 may vary in length and width, but, in one embodiment, may extend substantially the width of base plate 402. By coupling tab 422 to and/or over portion 80 and tab 422 to and/or under portions 32 and 40, accessory 400 may be effectively locked into position, restraining accessory 400 from movement other than laterally along portion 60.

Figure 13:
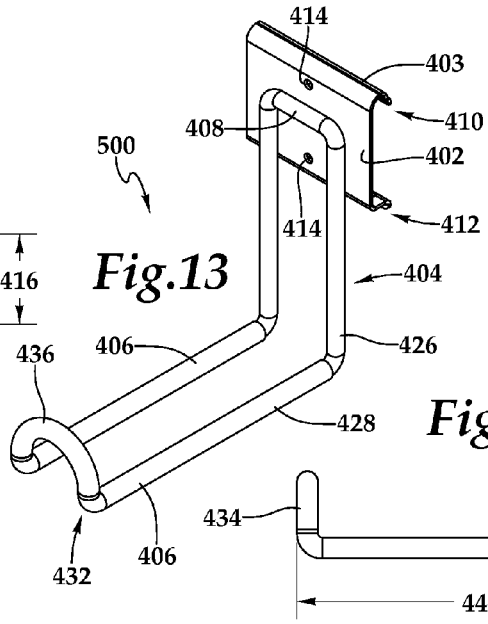
FIG. 13 is one embodiment of a hook.
Figure 13A:
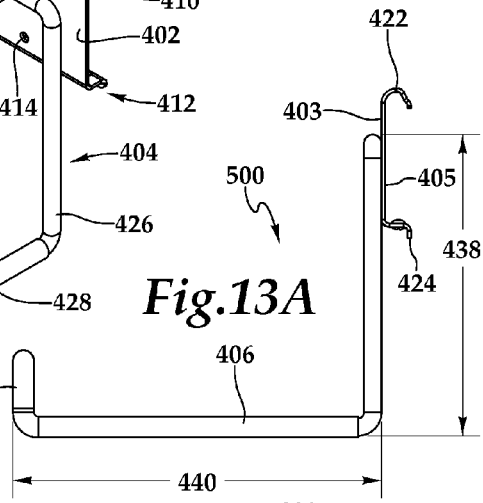
FIG. 13A is a side view of the hook of FIG. 13.

As shown in at least FIG. 13, at least one accessory 400 may further include a generally symmetrical wireform 404 having a predetermined shape and having a pair of legs 406 with a portion or brace 408 therebetween, wherein brace 408 may increase rigidity and inhibit bending. In one embodiment, brace 408 is substantially normal to legs 406 and is configured to position legs 406 at a predetermined distance 409 apart. In one embodiment, as shown in FIG. 13, distance 409 may be positioned between about 0.5" inch and about 6", preferably between about 1" and about 4" inch and, in one embodiment, about 2" or 1.930" apart.

Wireform 404 may be welded to base plate 402 wherever wireform contacts base plate 402. Preferably, brace 408 has a welded length between about ½ inch and about 1½ to secure wireform 404 to base plate 402.

Legs 406 also may be joined at a forward end to form a continuous structure extending down from base plate 402, along legs 406 and back to base plate 402. At least one and potentially two or more legs 406 extend downward or outward from base plate 402 for holding an object. Leg(s) 406 are spaced to improve the load capacity for accessory 400.

Figure 19:
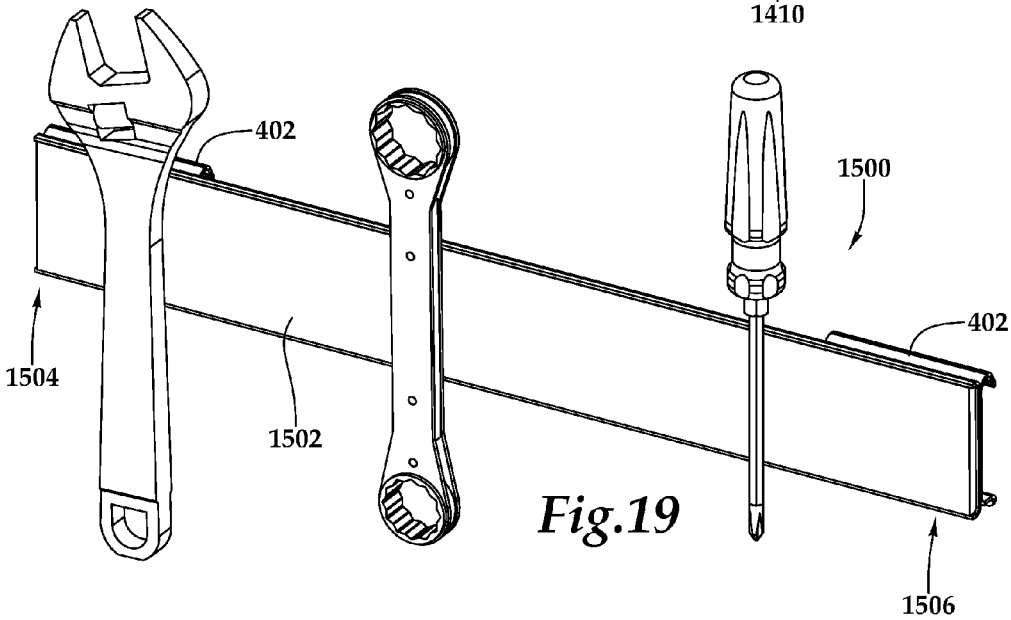
FIG. 19 is one embodiment of an accessory with a strip.

As seen in at least FIG. 19, at least one accessory 400 may include more than one base plate 402 with a support panel 409 extending therebetween. Accessories 400 further may include an accessory cover 450 configured to couple to at least base plate 402. Additionally, at least one accessory 400, as shown in at least FIG. 22, may be configured to couple to shelf 200, 220.

When accessory 400 is coupled to base 20, legs 406 may be spaced a small predetermined distance from wall or mounting surface. In this way, loading on system 10 and fasteners may have a larger shear component than a bending component, thereby increasing the holding strength of system 10.

Legs 406 may have upturned ends to prevent objects from sliding off accessory 400 or from being accidentally dislodged from accessory 400. Leg 406 may also be coated with a rubberized or plasticized material to increase friction between leg 406 and object, further inhibiting sliding of object.

Legs 406 may extend outward in varying degrees to allow system 10 to store a variety of products. For example, accessories 400 may extend substantially the same distance from a wall or mounting surface as shelf 200, 220 to hold wider objects, such as a hose. Further, accessories 400 may also be spaced apart to allow passage of an object, such as a broom or shovel handle, while allowing the broom head or shovel to rest on legs.

Legs 406 may come in many configurations, including straight legs, J-shaped legs, C-shaped legs, bicycle hooks, ladder hooks, tool hooks, coat or hat hooks, or a U-shaped pair of legs 28. Each leg 406 may extend axially out from base plate 402, but, preferably, legs 406 may extend laterally along an outer surface that may be substantially parallel to the wall before extending away from base plate 402.

Figure 17:
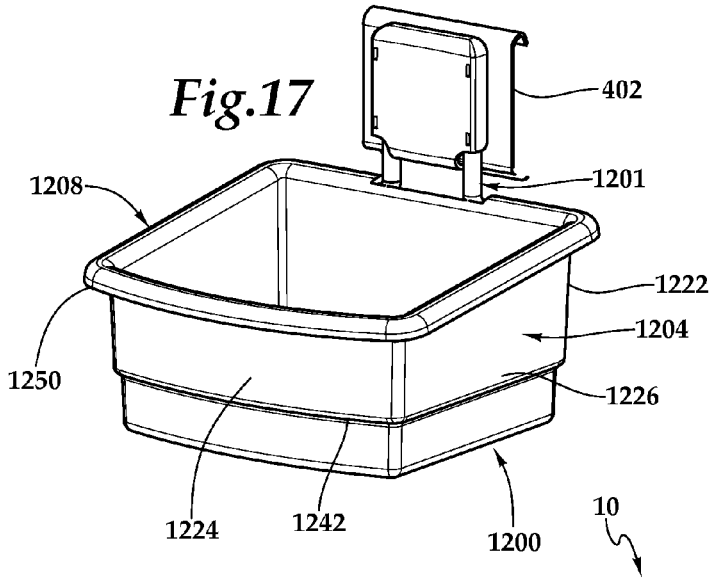
FIG. 17 is one embodiment of a hook and bin.

In one embodiment, a bin, such as the one shown in FIG. 17, may couple to legs 406 of wireform 404.

Accessory 400 may not be a unitary structure, but may comprise base plate 402 and leg(s) 406 operatively connected to base plate 402. Connection should be strong enough to keep legs 406 affixed to base plate 402 under loading conditions. Connection may comprise a fastener through legs and base plate. Preferably, connection is a weld. Several types of welds may be used, including spot welds. More preferably, however, connection is a fillet weld. Fillet weld may be between about ⅙ inch and about ⅜ inch, preferably about ⅛ inch. In addition, fillet weld may extend substantially around a perimeter defining the contact between base plate 402 and legs 406.

Accessory Cover 450

Figure 12:
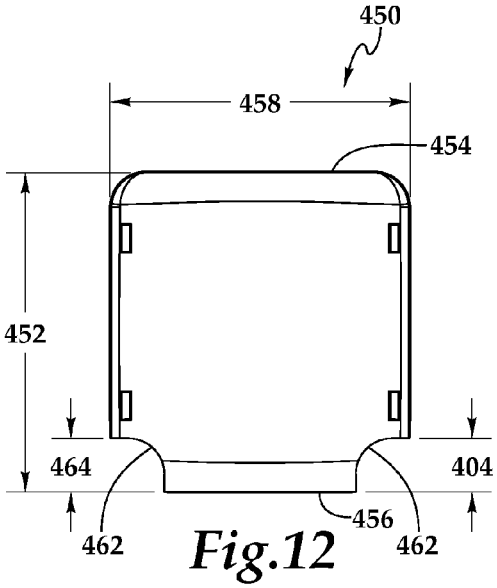
FIG. 12 is a front view of an accessory cover.
Figure 12A:
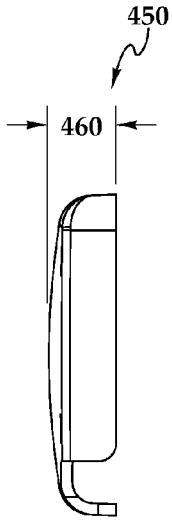
FIG. 12A is a side view of the accessory cover shown in FIG. 12.

Turning to FIG. 12, accessory 400 may include an accessory cover 450 that is sized and shaped to couple to base plate 402. Cover 450 may have a height 452 between a top 454 and a bottom 456, a width 458 and a thickness 460. In one embodiment, cover 450 has two arcuate bends or cutouts 462 proximate bottom 456 such that bends 462 are configured to fit around or engage legs 406 and/or wire form 404. Height 452 may be between about 0.5" and about 5, preferably between about 1" and about 4", and in one embodiment about 2". Similarly, width 458 may be between about 0.5" and about 5" wide, preferably between about 1" and about 4", and in one embodiment, about 2" inch. Bends 462 have a height 464 that may be between about 0.1" and about 0.75", about 0.2" and about 0.5", and in one embodiment about 0.38". In one embodiment, cover 450 may be fabricated from a plastic material; however, in alternative embodiments, cover 450 may be fabricated from any suitable material.

Accessory 500

Turning to FIGS. 13, 13A and 13B, in one embodiment, an accessory 500 includes a base plate 402 and a pair of legs 406. In one embodiment, legs 406 may have a first segment 426 extending generally parallel to the base plate 402 and a second segment 428 extending outwardly of the base plate 402. Legs 406 are diametrically opposed, symmetrical about an axis 430, and may extend downward from surface 403 before bending to form a distal portion 432, formed by segment 428, that extends substantially perpendicular to base plate 402 so that legs 406 may be positioned so they are level and parallel with the floor.

Each leg 406 may have a foot 434 or an upturned end on distal portion 70 to prevent the object from sliding off or tipping over the end of legs 406. In one embodiment, foot 434 is substantially normal to segment 428. Upturned end or foot may have a height between about 0.25" inch and about 2", preferably between about 0.5" and about 1.75" inch and, in one embodiment, about 1.171". In one embodiment, such as in FIG. 13, first segment 426 may have a height 438 that may be between about 2" inch and about 12", preferably between about 4" and about 8" inch and, in one embodiment, about 5.180", and second segment 428 may have a width 440 that may be between about 2" inch and about 12", preferably between about 4" and about 8" inch and, in one embodiment, about 6".

Additionally, as shown in FIG. 13, each foot 434 is coupled together by an arcuate connector 436.

Accessory 600

Returning to FIG. 1C, an accessory 600 is similar to accessory 500; however, accessory 600 does not include a connector 436.

Accessory 700

Continuing with FIG. 1C, an accessory 700 is similar to accessory 500, but accessory 700 does not include connector 436 and width of accessory 700 may be shorter than width 440 of accessory 500. Accessory 700 may be configured to hold an object such as a broom, rake or the like.

Accessory 800

Figure 14:
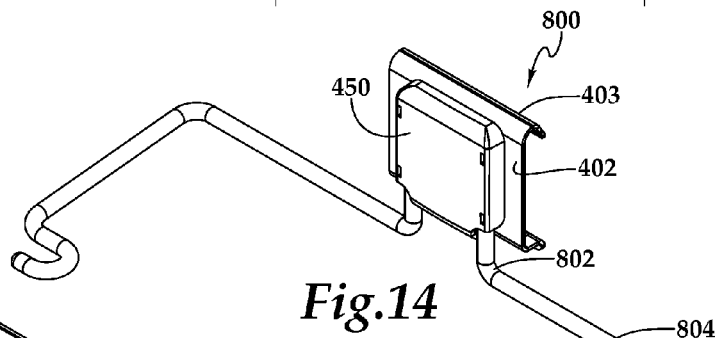
FIG. 14 is yet another embodiment of a hook.

Turning to FIG. 14, accessory 800 may be configured to hold an object such as a roll of paper towels or the like. Accessory 800 is similar to accessory 500; however, the predetermined distance between the legs of accessory 800 is greater than the distance between legs 406 in accessory 500, the feet on accessory 800 are arcuately shaped and the second segment 804 of the legs of accessory 800 may not be normal to base 402. In one embodiment, as shown in FIG. 14, each leg of accessory 800 may include a first segment 802 extending downward and substantially parallel to the substantially planar surface 403 of base 402, a second segment 804 extending outward from first segment 802 via a bend and remaining substantially parallel to surface 403 of base 402, and a third segment 806 extending outward from and substantially normal to surface 403 of base 402. Accessory 800 may also include arcuately shaped feet 808 at a distal end 805 of segment 806. In one embodiment, feet 808 have a hook shape.

Segment 806 may not be substantially planar with respect to surface 403 of base 402 but may form an angle with respect to surface 403 of base 402. The angle may be between about 80 degrees and about 150 degrees, preferably between about 90 degrees and about 130 degrees, and in the embodiment, about 96 degrees.

Accessory 900

Returning to FIG. 1C, accessory 900 may be configured to hold an object such as a hose or the like. Accessory 900 is similar to accessory 500; however, first segment of accessory 900 is longer than accessory 400, and a predetermined distance between legs is greater at a distal end of second segment than at a proximal end of second segment, and feet are taller in accessory 900 than in accessory 500.

Accessory 1000

Figure 15:
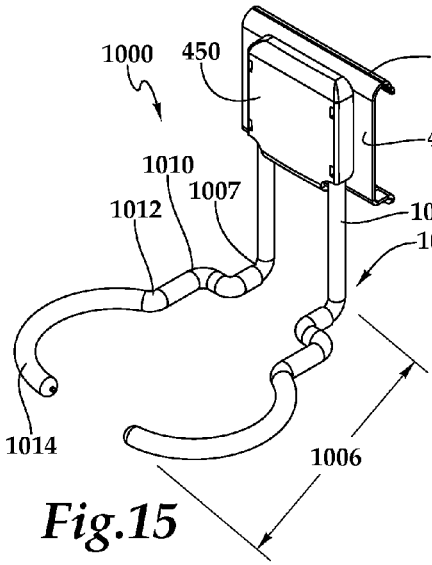
FIG. 15 is another embodiment of a hook.

Turning to FIG. 15, accessory 1000 may include a base 402 and a pair of legs 1002 that are spaced a predetermined distance apart to hold an object such as a power tool, drill or the like. Each leg 1002 may include a first segment 1004 that extends downward and substantially parallel to surface 403 of base 402 and a second segment 1006 that may be substantially normal to base 402 and extends outward via a bend 1007. Second segment 1006 may include a plurality of arcuate bends, such as bend 1008 extending outward from bend 1007, a bend 1010 extending outward from bend 1008, a bend 1012 extending outward from bend 1010, and a large bend or arcuate portion 1014 extending outward from bend 1012. In one embodiment, bends 1014 face one another forming an opening to hold an object therein.

Accessory 1100

Figure 16:
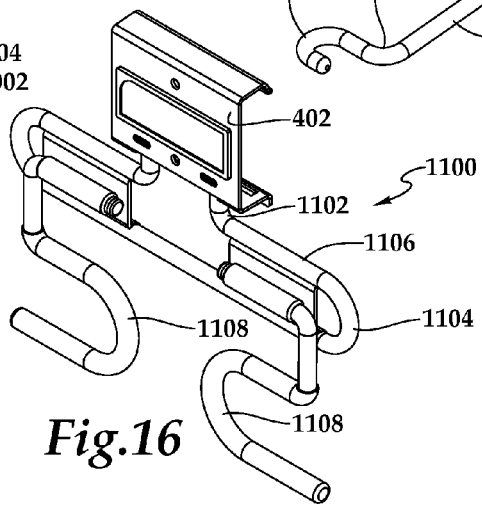
FIG. 16 is yet another embodiment of a hook.

Turning to FIG. 16, accessory 1100 may be a two-handle hook, wherein the hooks pivot proximate base 402. Accessory 1100, as shown in FIG. 19, has a storage position and an erect position. In the erect position, the hooks may pivot proximate base 402 to hold items such as a broom, rake, shovel, mop or the like.

The hooks of accessory 1100 include a first segment 1102 that extends from base 402, wherein first segment 1102 is substantially parallel to surface 403 of base 402. A second segment 1104 may be configured to extend between first segments 1102 and may have any shape. In one embodiment, as shown in FIG. 16, second segment 1104 may have an arcuate, oval shape. Accessory 1100 further includes a connector or hinge 1106 that facilitates pivoting and connection between segment 1104 and a third segment or hook 1108. In one embodiment, accessory 1100 includes two hooks 1108, wherein each hook 1108 has an L-shaped portion and a U-shaped arcuate portion extending therefrom via a bend. Further, in one embodiment, the U-shaped portions may be turned outward, such that the hooks do not face one another.

Accessory 1200

Turning to FIG. 17, accessory 1200 may include a base 402 to couple to base 20 of system 10, a pair of legs 1201 extending from base 402, and a bin 1204 that may be operatively coupled to legs 1201.

In one embodiment, legs 1201 are substantially similar to legs of accessory 800; however, legs 1201 may have different dimensions than legs of accessory 800 and feet of legs 1201 may have a different shape.

Bin 1204 of accessory 1200 may couple to or interface with legs 1201. Specifically, legs 1201 may couple to or interface with a lip 1250 of bin 1204. Lip 1250 may be proximate a top edge 1208 of bin 1204. In one embodiment, bin 1204 has a substantially rectangular shape and may be configured to hold a plurality of items. Bin 1204 may include a rear surface 1222, a front surface 1224 and side surfaces 1226. In one embodiment, front surface 1224 is arcuate between side surfaces 1226. Additionally, bin 1204 may have a step 1242 formed in surfaces 1222, 1224 and 1226.

Accessory 1300

Returning to FIG. 1C, accessory 1300 may be substantially similar to accessory 1200; however, accessory 1300 may have different dimensions than accessory 1200. For example, bin 1302 is longer and shallower than bin 1204. Bin 1302 also may have a divider to form compartments therein. In one embodiment, the divider is removable.

Accessory 1400

Figure 18:
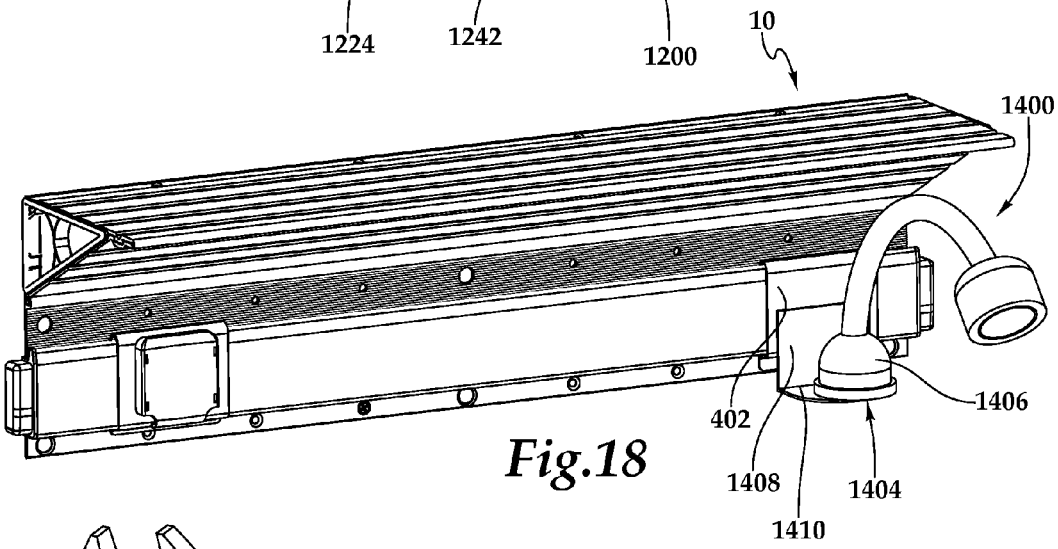
FIG. 18 is one embodiment of an accessory with a light.

Turning to FIG. 18, accessory 1400 may include a base plate 402 configured to couple to base 20. Accessory 1400 may include a ledge 1404 and a task light or work lamp 1406 coupled to ledge 1404. In one embodiment, ledge 1404 has a first portion 1408 that is coupled to base 402 and is substantially parallel thereto, and a second portion 1410 that extends outward and is substantially normal to first portion 1408.

Accessory 1500

Turning to FIG. 19, accessory 1500 may include at least one base plate 402. In one embodiment, accessory 1500 further includes a magnetic strip 1502 having a first end 1504 and a second end 1506 with a base plate 402 proximate first end 1504 and a base plate 402 proximate second end 1506. In one embodiment, strip 1502 has a height that is substantially the same as the height of base plate 402. A plurality of metal tools, such as a wrench, screwdriver or the like, may removably couple to strip 1502.

Accessory 1600

Figure 20:
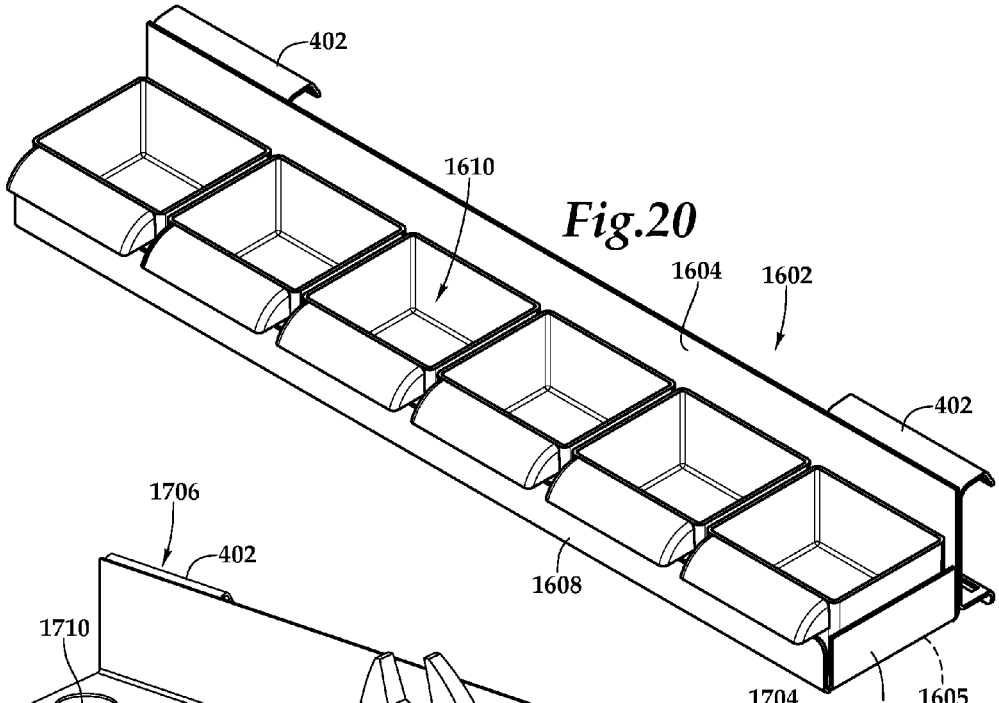
FIG. 20 is one embodiment of a tray.

Turning to FIG. 20, accessory 1600 may be similar to accessory 1500; however, accessory 1600 includes a tray 1602, rather than a strip 1502. In one embodiment, tray 1602 may include a base strip 1604 that may extend between base plates 402, a bottom strip 1605 that extends outward from and is substantially normal to strip 1604, side strips 1606 that extend upward from and substantially normal to strip 1605, and a front strip 1608 that extends upward from and substantially normal to strips 1605 and 1606. In one embodiment, strips 1606 and 1608 have a height that is less than that of strip 1604.

Tray 1602 may be configured to receive a plurality of mini-bins therein, wherein each mini-bin may be removed from tray 1602. Each mini-bin may include an arcuate lip 1610 extending therefrom, wherein lip 1610 may be configured to interface with strip 1608.

Accessory 1700

Figure 21:
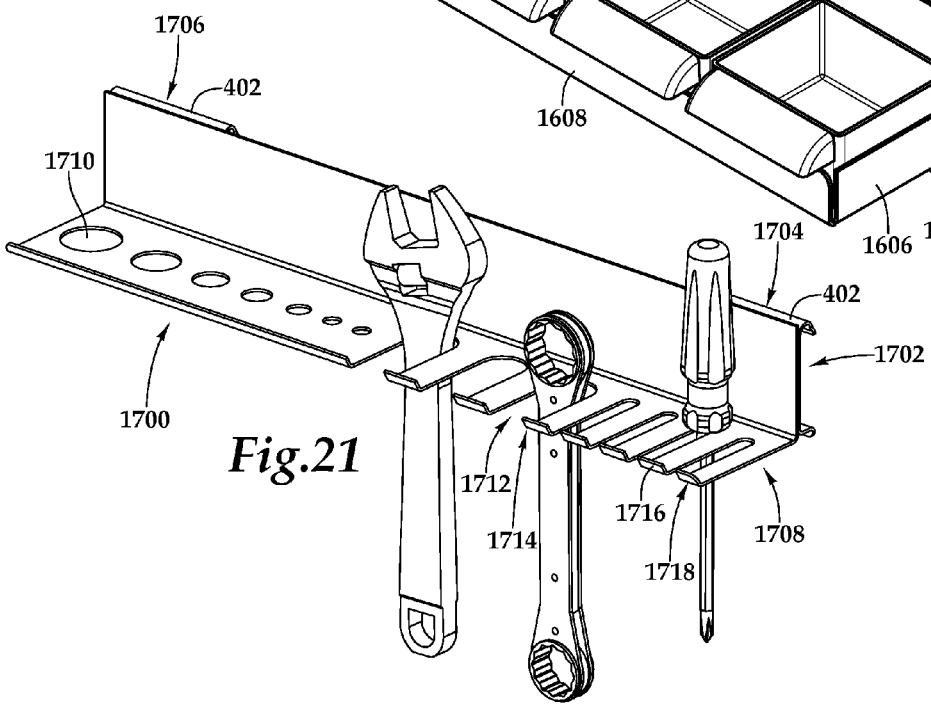
FIG. 21 is another embodiment with a strip.

Turning to FIG. 21, accessory 1700 may be similar to accessory 1500; however, accessory 1700 includes a plurality of strips. Accessory 1700 includes a base strip 1702 having a first end 1704 and a second end 1706 with a base plate 402 proximate first end 1704 and a base plate 402 proximate second end 1706. In one embodiment, strip 1702 has a height that is substantially the same as the height of base plate 402.

In one embodiment, accessory 1700 also may include a second strip 1708 that extends outward from and substantially normal to first strip 1402. Second strip 1708 may be configured to hold a plurality of items, such as a plurality of tools, such as a wrench, screwdriver, hammer or the like. Strip 1708 may include a plurality of openings 1710 and a plurality of slots 1712 separated by slats 1714. In one embodiment, openings 1710 are proximate end 1706 and slots 1712 and slats 1714 are proximate end 1704. Openings 1710, slots 1712 and corresponding slats 1714 may vary in size to accommodate many different types of tools. In one embodiment, openings 1710 decrease in size between end 1706 and end 1704, and, similarly, slots 1710 and slats 1712 decrease in size between end 1706 and end 1704. In one embodiment, slats 1714 may include upturned tabs 1716 proximate distal end 1718 to facilitate retaining tools within accessory 1700.

Accessory 1800

Figure 22:
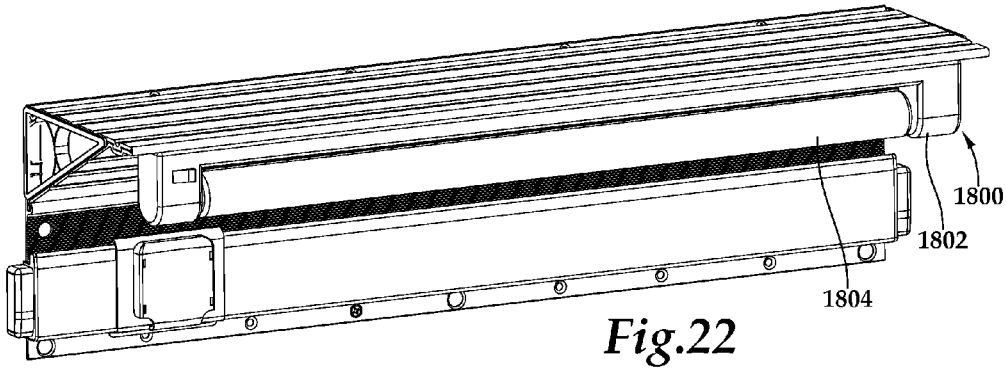
FIG. 22 is another accessory with a light.

Turning to FIG. 22, accessory 1800 may be configured to couple to shelf 200, 220. In one embodiment, accessory 1800 includes a light 1804 in a housing 1806 coupled to, extending from or formed integrally with shelf 200, 220. Light 1804 may be a fluorescent tube light, a battery or wall powered LED light, a spot light and/or a task light.

System 2010

Similar to system 10, rail storage system 2010 is mountable to a wall, mounting surface or substrate such as drywall with at least one fastener and system 2010 is used for holding, typically hanging, objects (not shown), such as a tool, a rake, a ladder or the like. Both systems 10 and 2010 may include a base or rail, an accessory configured to couple to the base or rail, an optional shelf or cover, and a removable endcap.

Figure 23:
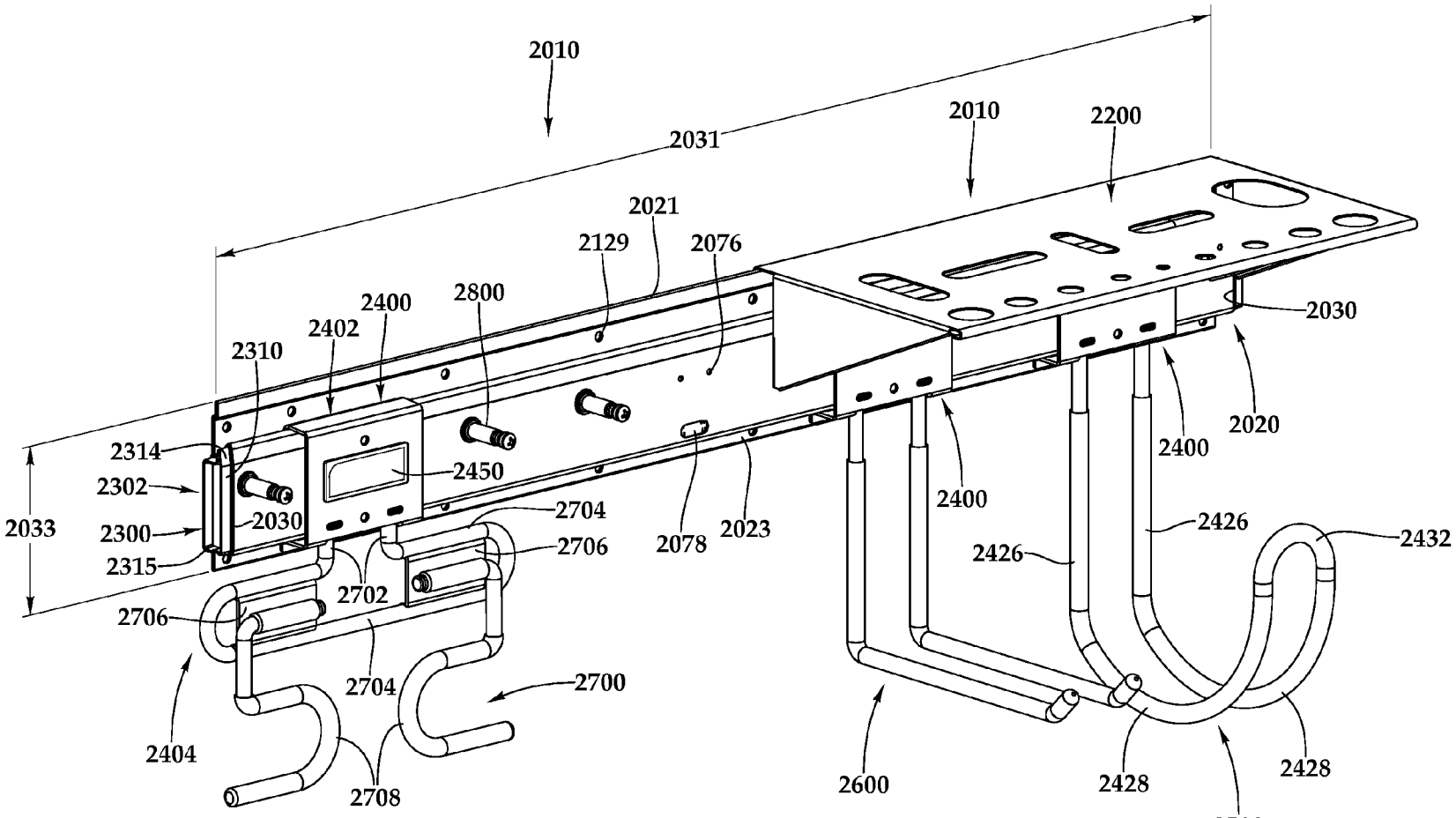
FIG. 23 is a perspective view of another embodiment of a storage system mountable to a wall.
Figure 24:
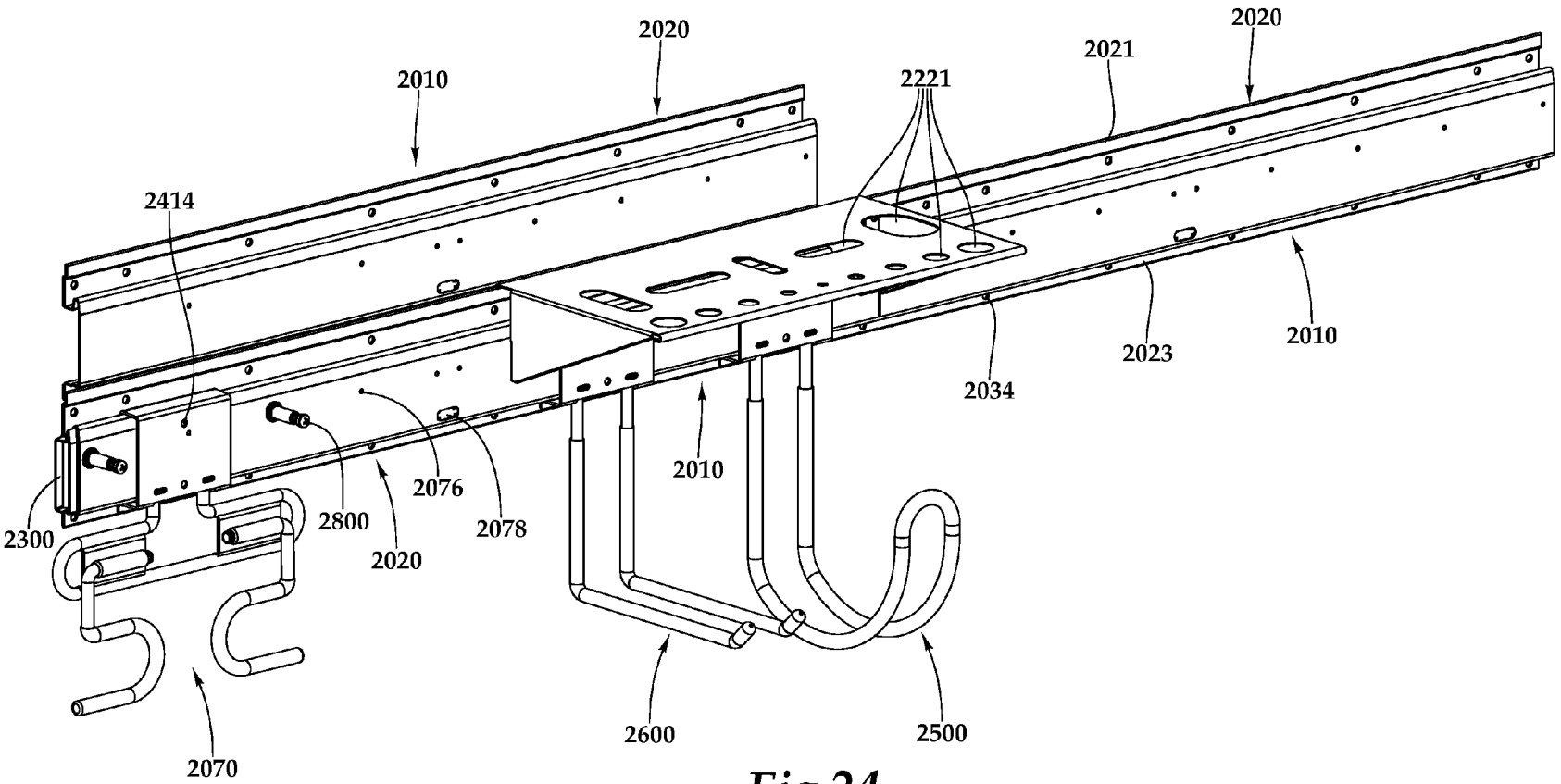
FIG. 24 is a perspective view of a plurality of storage systems shown in FIG. 23.

System 2010 may include a base or rail 2020 and at least one accessory 2400, as shown in FIGS. 23 and 24. Further, as shown in FIGS. 23 and 24, system 2010 may include at least one shelf 2200 and/or at least one endcap 2300. Also as shown in the figures, system 2010 may be coupled to one or more additional systems 2010.

Base 2020

Figure 25:
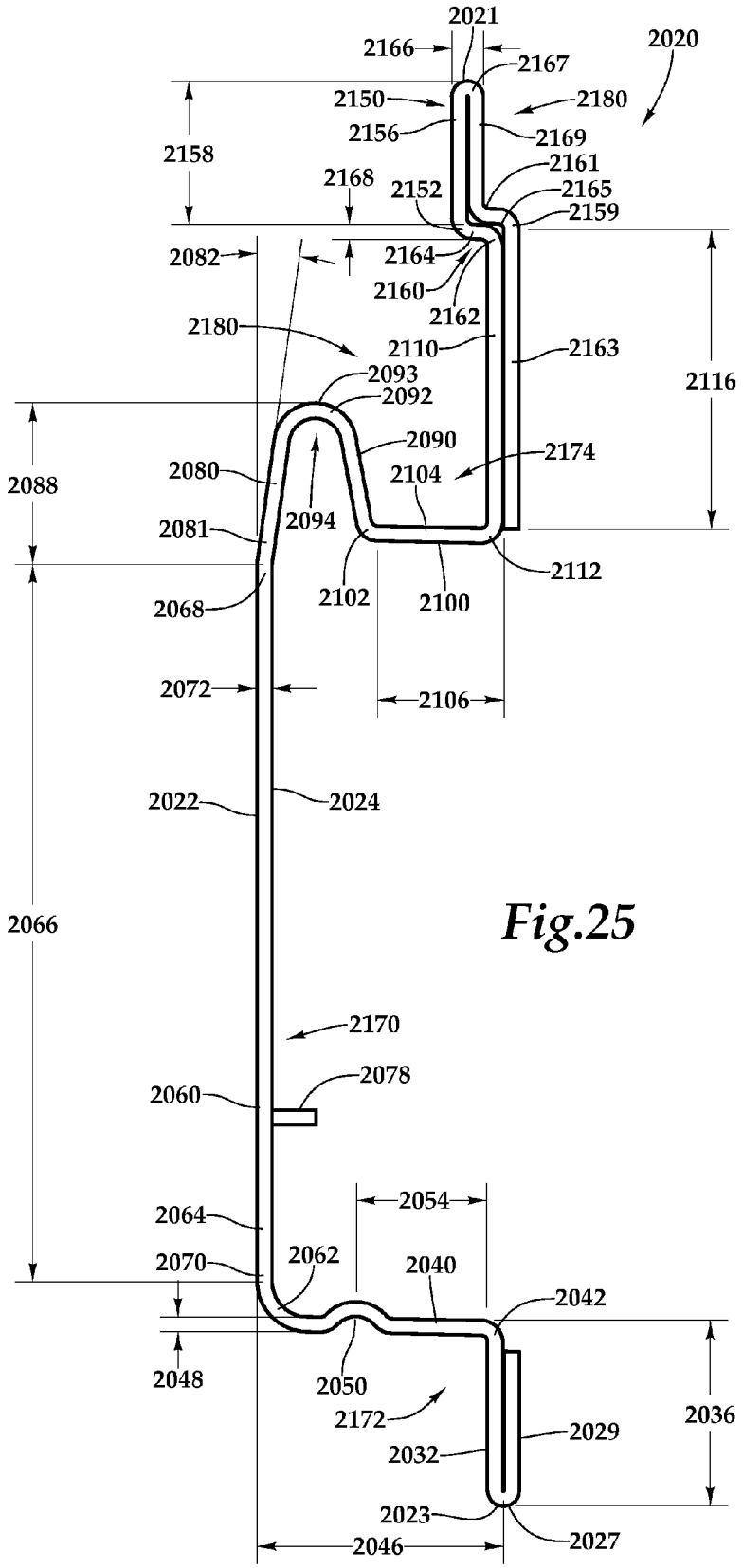
FIG. 25 is a side view of one embodiment of a rail shown in FIG. 23.

Turning to FIGS. 23-25, a storage system 2010 may include at least one base or rail 2020. As shown in the figures, base 2020 may be coupled horizontally with one or more additional bases 2020. Base 2020 further may be coupled vertically with one or more additional bases 2020.

Each base 2020 may include a first edge 2021, a front surface 2022, a second edge 2023, a rear surface 2024 and sides 2030. Base 2020 further may have a plurality of portions, such as portions 2029, 2032, 2040, 2060, 2080, 2110, 2100, 2150, 2160, 2163, 2165 and 2169. In one embodiment, each portion 2029, 2032, 2040, 2060, 2080, 2100, 2110, 2150, 2160, 2163, 2165 and 2169 extends along entire length 2031 of base 2030. In another embodiment, each portion 2029, 2032, 2040, 2060, 2080, 2100, 2110, 2150, 2160, 2163, 2165 and 2169 extends along only a portion of length 2031 of base 2030. Length 2031 may be between about 1" and about 72", preferably between about 6" and about 48", and in one embodiment, about 24". In one embodiment, base 2020 is unitarily formed. In alternative embodiments, base 2020 may be fabricated as a plurality of members or portions that are coupled together. Base 2020 may have an overall height 2033 that may be between about 1" and about 18", preferably between about 4" and about 12", and in one embodiment, about 6.5". Alternatively, base 2020 may have any height 2033 that facilitates use and/or operation of base 2020 with system 2010.

A first portion 2032 of base 2020 may be substantially parallel or flush with respect to a wall. As shown in FIG. 24, portion 2032 may include a plurality of openings 2034 such that a fastener may be inserted through each opening to engage a wall or surface. Each opening 2034 may have an ingress within front surface 2022 and an egress within rear surface 2024. In one embodiment, each opening 2034 may have a constant diameter between surfaces 2022, 2024. In another embodiment, the ingress may have a diameter that is different than a diameter of the egress. For example, the ingress diameter may be larger than the egress diameter to engage a head of a fastener. Moreover, openings 2034 may have diameters of varying size.

Turning to FIG. 25, portion 2032 may have a height 2036 and a generally constant thickness 2038. In one embodiment, height 2036 is sized such that an opening 2034 within portion 2032 is sized to receive a fastener. The fasteners enable system 2010 to be mounted anywhere in a wall or mounting surface. Height 2036 may be between about 0.25" and about 4", preferably between about 0.5" and about 3", and in one embodiment, about 0.5".

Moreover, openings 2034 may have generally collinear centers to install fasteners along a common line. However, the openings may be horizontally offset from one another, staggered, or in any other configuration. Openings 2034 may be spaced equidistantly, for example, about every 4 to 6 inches. Openings 2034 are spaced such that base 2020 may be coupled to a wall or mounting surface with studs that are approximately 16 inches apart or approximately 24 inches apart.

As shown in FIG. 25, base 2020 also may include a lower wall engaging or folded over portion 2029 to provide additional strength of portion 2032 and/or base 2020. Portion 2029 may be configured to engage a portion of a wall, such that a surface of portion 2029 may abut or engage a portion of a wall. Portion 2029 may be connected to portion 2032 via a bend 2027 and may be substantially parallel to portion 2032 and/or a wall. Additionally, portion 2029 may have a height that is substantially the same as height 2036. Moreover, portion 2029 may abut surface 2024 of portion 2032.

In one embodiment, portions 2029 and 2032 may be referred to as a lower portion.

Continuing with FIG. 25, base 2020 further may include a second or extension portion 2040. In one embodiment, extension portion 2040 is substantially normal via a bend 2042 to portion 2029 and/or portion 2032 and extends outwardly from portion 2032, and further has a straight part 2044 with a width 2046. Width 2046 may be between about 0.05" and about 2", preferably between about 0.1" and about 0.75", and in one embodiment, about 0.63". Also in one embodiment, portion 2040 has a thickness 2048, wherein thickness 2048 is substantially constant. Further, in one embodiment, thickness 2048 maybe the same as thickness 2038. Portion 2040 also may include an indentation 2050 configured to engage or interface with accessory 2400. Indentation 2050 may be positioned a distance 2054 from portion 2032 and may have a radius of curvature 2052.

Base 2020 also may include a third portion or protrusion 2060 configured to engage or interface with a base plate 2402 of at least one accessory 2400. In one embodiment, protrusion 2060 is substantially normal via a bend 2062 to lower extension portion 2040 and extends upwardly therefrom, and further has a straight part 2064 with a height 2066 that extends between a top or upper edge 2068 and a bottom or lower edge 2070. Height 2066 may be between about 0.25" and about 7", preferably between about 0.5" and about 5", and in one embodiment, about 2". In one embodiment, height 2066 is more than three times height 2036. Protrusion 2060 may be substantially parallel to portions 2032 and/or a wall or mounting surface.

Protrusion 2060 has a thickness 2072 and, in one embodiment, thickness 2072 is substantially constant between edges 2068 and 2070. Alternatively, thickness 2072 may vary between top 2068 and bottom 2070. For example, thickness 2072 may be greater proximate bottom 2070 than proximate top 2068. In one embodiment where thickness 2072 is greater proximate bottom 2070, rear surface 2024 of thicker portion 2074 may form an obtuse angle with rear surface 2024 of straight part 2064. Moreover, in one embodiment, thickness 2072 may be about 1.5 times thicker proximate bottom 2070 than proximate top 2068.

Protrusion 2060 further may include at least one leveling bubble 2078 and/or a plurality of openings 2076 such that a fastener may be inserted through each opening to engage a wall or surface. Each opening 2076 may have an ingress within front surface 2022 and an egress within rear surface 2024. In one embodiment, each opening 2076 may have a constant diameter between surfaces 2022, 2024. In another embodiment, the ingress may have a diameter that is different than a diameter of the egress. For example, the ingress diameter may be larger than the egress diameter to engage a head of a fastener. Moreover, openings 2076 may have diameters of varying size. Additionally, openings 2034 and 2076 may be substantially similar.

Moreover, openings 2076 may have generally collinear centers to install fasteners along a common line. However, the openings may be horizontally offset from one another, staggered, or in any other configuration. Openings 2076 may be spaced equidistantly, for example, about every 2 inches. Openings 2076 are spaced such that a shelf 2200 or accessory 2400 may be coupled at varying positions along the length of base 2020.

Continuing with FIG. 25, base 2020 may include a fourth or upper accessory engaging portion 2080 that may be configured to receive or interface with accessory 2400. In one embodiment, portion 2080 has a part 2081 having a length 2088 that is angled upwardly and inwardly at an angle 2082 via a bend 2084 with respect to straight part 2064 of portion 2060, and portion 2080 has a part 2090 that is angled downwardly and outwardly via a bend 2092 with respect to part 2081. Part 2090 may also have a length 2088. Angle 2082 may be between about 5 degrees and about 50 degrees, preferably between about of about 10 degrees and 40 degrees, and in one embodiment, about 30 degrees, and length 2088 may be between about 0.05" and about 2", preferably between about 0.1" and about 1", and in one embodiment, about 0.2" or about ¼". In one embodiment, upper accessory engaging portion 2080 may extend from protrusion 2060 past upper extension portion 2100 in the direction of first edge 2021 to a distal end 2093, and bend back to connect to upper extension portion 2100.

In one embodiment, portion 2080 includes an indentation 2094. Indentation 2094 may have a radius of curvature. Indentation 2094 may be vertically offset from indentation 2050. For example, indentation 2094 may be a greater distance from a wall or substrate than indentation 2050. For another example, indentation 2094 may be a greater distance from portion 2032 than indentation 2050. The offset may provide stability and strength during use and manufacturing of base 2020 and/or system 2010.

Base 2020 also may include a fifth or upper extension portion 2100. Portions 2040 and 2100 enable portion 2060 to be positioned a distance from wall or substrate and, in one embodiment, portions 2040 and 2100 are substantially parallel to one another and/or are substantially normal to wall or mounting surface. In one embodiment, upper extension portion 2100 is substantially normal via a bend 2102 to part 2090 of portion 2080 and extends outwardly therefrom, and has a straight part 104 with a width 2106. Width 2106 may be less than width 2046, and width 2106 may be between about 0.05" and about 2", preferably between about 0.1" and about 0.75", and in one embodiment, about 0.5". Also, in one embodiment, portion 2040 has a substantially constant thickness 2108, wherein thickness 2108 may be substantially the same as thickness 2038 and 2048.

Continuing further with FIG. 25, base 2020 may include a sixth portion or upper wall engaging portion 2110. In one embodiment, portion 2110 is substantially parallel to portions 2060 and/or portion 2032 and/or wall. In one embodiment, portion 2110 is substantially normal via a bend 2112 to portion 2100 and extends upwardly therefrom, and further has a straight part with a height 2116. In one embodiment, height 2116 is less than height 2066, and height 2116 may be between about 0.25" and about 4", preferably between about 0.5" and about 3", and in one embodiment, about 1.5". Also in one embodiment, portion 2040 has a thickness 2118 that is substantially constant, wherein thickness 2118 may be substantially the same as thickness 2038 and 2048.

As shown in FIG. 24, in one embodiment, portion 2110 includes a plurality of openings 2129 such that a fastener may be inserted through each opening to engage a wall or mounting surface. In one embodiment, openings 2129 have diameters of substantially similar sizes. Further, in one embodiment, openings 2129 may be substantially similar to openings 2034. Portion 2110, similar to portion 2032, may have a generally constant thickness and may be generally planar. In one embodiment, height 2116 is sized such that an opening 2129 within portion 2110 is sized to receive a fastener therein. Fasteners enable system 2010 to be mounted anywhere in a wall or mounting surface.

In one embodiment, portions 2040, 2060, 2080, and 2100 may be referred to as an accessory portion.

Continuing with FIG. 25, a seventh portion 2160 also may be configured to engage a portion of a cover or shelf 2200 and/or a portion 2032 of a second rail or base 2020. In one embodiment, portion 2160 is substantially normal via a bend 2162 to portion 2110 and extends outwardly therefrom, and further has a straight part 2164 with a width 2166. Width 2166 may be between about 0.1" and about 2", preferably between about 0.25" and about 1", and in one embodiment, about 0.5". Further, width 2166 may be less than width 2046 and/or less than width 2106. Alternatively, width 2166 may have any width that is suitable to facilitate operation and use of base 2020. Portion 2160 may have a substantially constant thickness 2168. In one embodiment, thickness 2168 is substantially the same as a thickness 2159.

An eighth portion 2150 may extend upwardly with respect to portion 2160, may be substantially normal to portion 2160 via a bend 2152, and further has a straight part 2156 with a height 2158. Height 2158 may be between about 0.25" and about 4", preferably between about 0.25" and about 3", and in one embodiment, about ⅜". In one embodiment, portion 2150 is substantially parallel to portion 2110. Portion 2150 may be generally planar and may have a substantially constant thickness. In one embodiment, height 2158 is substantially the same as height 2036.

As shown in FIG. 25, base 2020 also may include folded over portions 2169, 2165 and 2163 to provide additional strength of portions 2110, 2150 and 2160, respectively, and/or base 2020.

Portion 2169 may be connected to portion 2032 via a bend 2167 and may be substantially parallel to portion 2150. Additionally, portion 2169 may have a height that is substantially the same as height 2158. In another embodiment, portion 2169 may have a height that is substantially the same as height 2036. Moreover, portion 2169 may abut surface 2024 of portion 2150.

Portion 2165 may be substantially normal to portion 2169 via a bend 2161 and may be substantially parallel to portion 2160. Additionally, portion 2165 may have a height that is substantially the same as width 2166. Moreover, portion 2165 may abut surface 2024 of portion 2160.

Portions 2165 and 2169 may be configured to engage a portion of shelf 2200, such as a ledge 2216. Portions 2165 and 2169 further may be configured to engage a portion 2032 of a second or additional base 2020.

Portion 2163 may be substantially normal to portion 2165 via a bend 2159 and may be substantially parallel to portion 2110. Portion 2163 may be configured to engage a portion of a wall or substrate. Additionally, portion 2163 may have a height that is substantially the same as height 2116. Also, height 2116 may be greater than height 2158. Moreover, portion 2163 may abut surface 2024 of portion 2110. Folded-over sections of upper and lower flanges may be welded together in places to keep the flanges immediately adjacent to one another and to increase strength.

In one embodiment, portions 2110, 2150, 2160, 2163, 2165 and 2169 may be referred to as an upper ledge portion.

Continuing further with FIG. 25, front surface 2022 further may comprise a plurality of tracks, grooves, ledges or channels 2170, 2172, 2174 and 2180. In one embodiment, front surface 2022 may comprise generally parallel channels 2172, 2174 and 2180, wherein the channels may extend substantially along length 2031, defined between sides 2030, of base 2020. In one embodiment, rear surface 2024 of portion 2060 may comprise channel 2170, wherein the channels may extend substantially along length 2031 of base 2020. In addition, each channel 2170, 2172, 2174 and 2180 may be shaped differently, and may have different purposes as described herein.

A bottom accessory channel 2172 may be proximate bottom of base 2020. In one embodiment, channel 2172 is defined by surface 2022 of portion 2032 and surface 2022 of portion 2040. Bottom channel 2172 may interface with an accessory or accessories 2400 and/or another base 2020. Moreover, bottom channel 2172 may include indentation 2050 in front surface 2022 of portion 2040 to facilitate interfacing and/or retaining an accessory or accessories 2400 with base 2020. Channel 2172 may assist in preventing vertical motion of accessory or accessories 2400 and/or another base 2020 and/or preventing motion in a direction other than generally along a length of channel 2172.

Channel 2170, may be generally formed by the rear surface 2024 of portion 2060. In one embodiment, channel 2170 is defined by surface 2024 of portion 2040, surface 2024 of portion 2060, and surface 2024 of portion 2100. Channel 2170 may assist in preventing vertical motion of accessory or accessories 2400 and/or another base 2020 and/or preventing motion in a direction other than generally along a length of channel 2170.

An upper accessory channel 2174 may be formed generally by portions 2080, 2100, 2110 and may be configured to interface with an accessory 2400. As part 2081 of portion 2080 has an incline or angle 2082, the incline may increase the contact surface area between surface 2024 and accessories 2400, increasing holding strength and creating greater stability for system 2010. The incline may also make it more difficult for accessories to become dislodged when a load is applied to or removed from accessory 2400.

Channel 2174 may increase the shear component of the force exerted by an object suspended from accessory 2400 and, thereby, reduce the bending moment exerted by the object on system 2010 and on accessories 2400 holding storage system 2010 to a wall or mounting surface. This may be accomplished through one or more structural considerations that decrease the distance between the wall or mounting surface and rear side of channel 2174, i.e., surface 2022 of portion 2060, and/or decrease the distance between the wall or surface and forward side of channel 2174, i.e., surface 2022 of portion 2110. In addition, rear surface 2024 may be generally flush with the wall or mounting surface. Moreover, surface 2022 of portion 2060 may be spaced a predetermined distance from surface 2022 of portion 2110.

Channel 2180 may be defined by portions 2165 and 2169 and may be configured to receive a portion of a cover or shelf 2200 and/or another base 2020.

Continuing with FIG. 25, length 2031 may be between about 12 inches and about 36 inches, preferably between about 14 inches and about 30 inches, still more preferably between about 16 inches and about 24 inches. Base 2020 may have a height 2186 defined between edge 2026 and projection 2130. Height 2186 may be between about 0.1" and about 4", preferably between about 1" and about 3", and in one embodiment, about 2.67". Base 2020 further may have a height 2188 defined between an edge 2192 and edge 2028.

Continuing further with FIG. 25, base 2020 may be comprised of a thin, relatively strong material to withstand repeated loading and unloading of accessories 2400 or covers or shelves and loads supported by accessories 2400 or shelves or other bases 2020. Base 2020 may be made of steel, plastic, or one or more other suitable materials. In one embodiment, base 2020 is made of rolled steel and may be of unitary construction. In another embodiment, base 2020 is made of a plurality of pieces operatively connected to one another, such as by welding, riveting or through other means. Portions 2029, 2032, 2060, 2110, 2150, 2163, and 2169 of base 2020 may be generally parallel to one another and/or generally parallel to a wall or mounting surface. As can be seen in the figures, rear surface 2024 of base 2020 may have a plurality of generally planar surfaces such that base may lay generally flush against mounting surface (not shown) when installed in order to minimize the distance that base 2020 extends from mounting surface and to increase shear component of loading, thereby increasing system 2010 holding strength.

Turns in steel may have radii of curvature, such as at the identified bends, so as to prevent the formation of stress concentrations or other areas of weakness. In one embodiment, radii of curvature are generally similar throughout turns of base 2020.

Base 2020 may be coupled to a wall or mounting surface with a plurality of fasteners. In the embodiment, shown in FIG. 24 and as mentioned herein, each of openings 2034 and 2129 is configured to admit a fastener having a crest diameter of at least about ¼ inch, preferably at least about ½ inch. For example, fasteners may be any type of fastener, such as fasteners sold under the trademark Tornado®, also commonly assigned. In a further example, fasteners may be any fastening means, such as a screw, that is suitable to mount system 2010.

Each fastener may include a head having a recess, such as a Phillips recess, for receiving a rotary driver so that system may be installed with a driving tool, such as a screwdriver or a drill with a screwdriver bit. Recess includes one or more torque transmitting surfaces so that torque may be transmitted from the rotary driver to rotate the fastener in order to drive the fastener through the wall.

In one embodiment, the openings, such as openings 2034 and 2129, in base 2020 may be sized slightly larger than major diameter of fasteners so as to allow free passage of fasteners during installation. In a further embodiment, the openings in base 2020 may be sized slightly smaller than major diameter of fasteners so as to meter fastener during installation. In another embodiment, the openings may have any size and may be configured to receive a fastener therein.

When the fastener is inserted through openings, such as base 2020 and/or shelf 2200 and/or accessories 2400, to a wall or mounting surface, so long as the fastener, and preferably the threads of the fastener, remains engaged with and/or under the control of the fixture, the fastener will not be stripped out from the wall, either by rotation or translation of the fastener. The engagement of the fastener (preferably the threads) with the fixture, along with inserting the fastener downwardly into the wall at an angle may prevent the fastener from stripping. Additionally, the fastener, when engaged with the fixture, has significant holding strength in holding the fixture to the wall.

The centers of each set of openings 2034, 2076, and 2129 may be collinear to install fasteners along a common line. Alternatively, the openings may be horizontally offset from one another, staggered, or in any other configuration. For example, openings 2034 defined within portion 2032 may have generally collinear centers to install fasteners along a common line. Additionally, openings 2034, 2076, and 2129 may be spaced equidistantly, for example, about every 6 inches. It is contemplated that system 2010 installed using fasteners as described above may have a holding strength of at least about 500 lbs of weight.

System 2010 allows a user to select a position anywhere on a wall or mountable substrate that is feasible to place the object desired to be held. System 2010 may be used for holding tools or other objects on interior or exterior walls or mountable substrates of a residential home and is particularly useful for hanging tools or other objects from a wall or ceiling within a garage. However, system 2010 may be equally usable in other applications.

The wall or mounting surface (not shown) may be one of several materials used in construction, such as stucco, plaster, or gypsum based drywall. Drywall typically has a thickness of about ½ inch or about ⅝ inch, but it may be obtained in other thicknesses, such as about ⅜ inch. Typically, friable substrates such as drywall are mounted to support studs, such as wood support studs, for example 2×4 studs or the like, evenly spaced apart, e.g. every 16 inches, or metal support studs, such as steel support studs. Studs are substantially more resistant to pullout than drywall because they are less friable and much less likely to break apart, but it may be harder to drive fasteners into studs.

Shelf 2200

As shown in FIGS. 23, 24, 26, and 27, system 2010 also may comprise a shelf 2200 configured to couple to base 2020, such as to portions 2060, 2150 and/or 2169, and may be configured to hold a plurality of objects, such as household tools or the like.

Shelf 2200 may extend a length between a first end 2222 and a second end 2224. Shelf 2200 further may extend a distance between an inner edge 2226 and an outer edge 2228. Shelf 2200 also may include a plurality of slots and/or openings 2221 of varying shapes and sizes that may be configured to receive items such as a tool, a hammer or other objects. Further, one or more items, such as tools, may be placed or laid on an outer surface 2202 of shelf 2200, when it is coupled to base 2020, to store or hold additional items.

Figure 26:
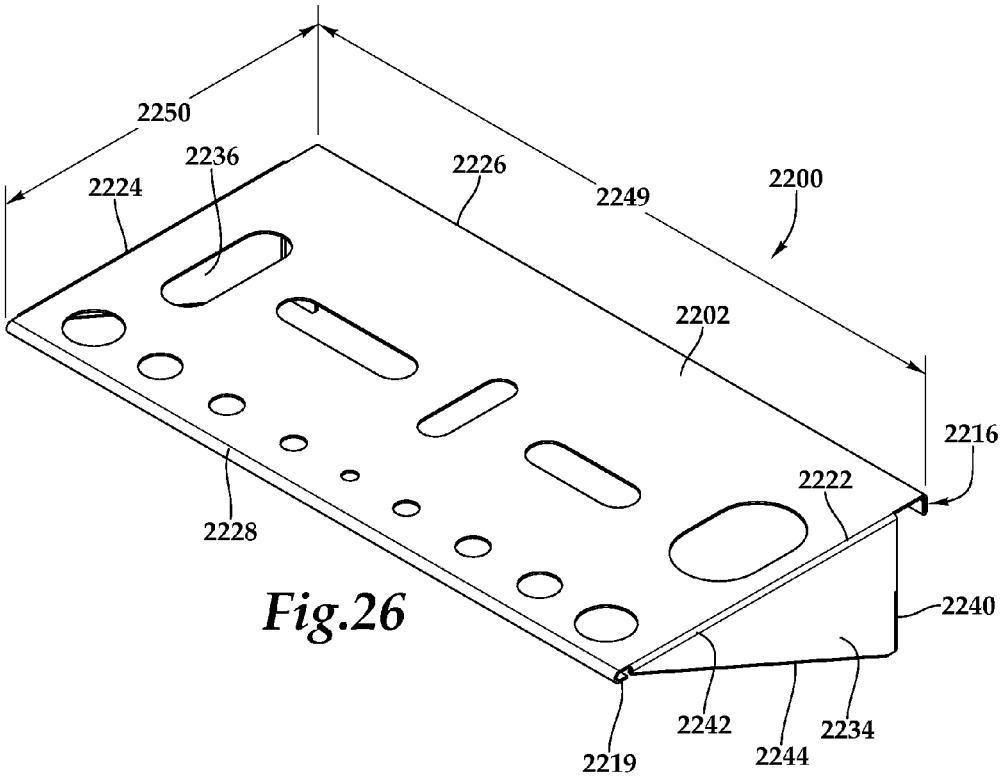
FIG. 26 is a front perspective view of a shelf shown in FIG. 23.
Figure 27:
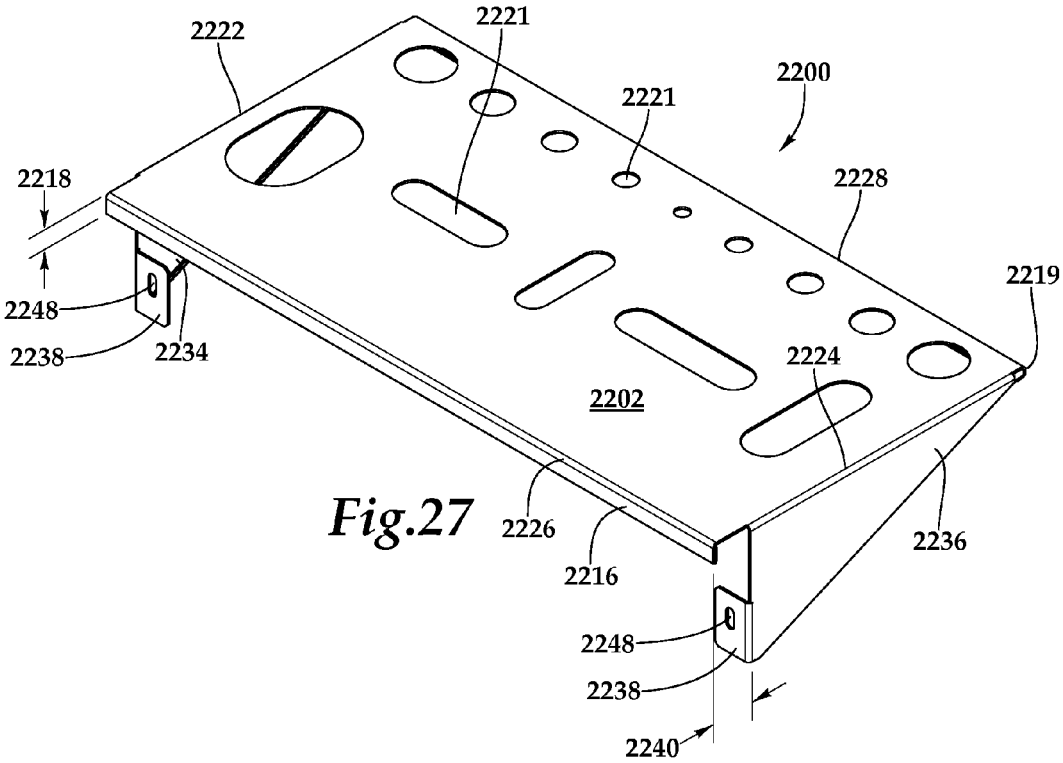
FIG. 27 is a rear perspective view of the shelf of FIG. 26.

Turning to FIGS. 26 and 27, shelf 2200 may have an outer surface 2202 and an inner surface. Outer surface 2202 may include a ledge 2216 that may be formed proximate edge 2226 and may be configured to engage or interface with portions 2150 and 2160 of base 2020. In one embodiment, ledge 2216 may have a height 2218 between about 0.05" and about 2", preferably between about 0.1" and about 0.75", and in one embodiment, about 0.5". In one embodiment, ledge 2216 has a height 2218 that is substantially similar to height 2158 to facilitate engaging shelf ledge 2216 with at least portion 2169. In one embodiment, ledge 2216 is or placed within channel 2180 and/or coupled to and/or abutted with portions 2150 and 2160. Additionally, ledge 2216 may include a fold over portion 2217 to provide additional strength to portion 2216.

Additionally, shelf 2200 may include a lip 2219. Lip 2219 may be rounded so that edge 2228 is not a sharp edge.

Shelf 2200 may further include at least one side 2234 proximate end 2222 and at least one side 2236 proximate end 2224 of shelf 2200. In one embodiment, each side 2234 and 2236 has a substantially triangular shape. For example, each side 2234 and 2236 may have an edge 2240, 2242, and 2244. Alternatively, each end 2234 may have any shape that facilitates its operation.

Each side 2234 and 2236 may include a flange 2238, such that flange 2238 is configured to couple to base 2020, which may facilitate anchoring shelf 2200 in place. Flange 2238 may be configured to abut base 2020, such as portion 2060, wherein flange 2238 and base 2020 may be substantially flush. Flange 2238 may be substantially normal to surface 2202. Moreover, flange 2238 may be substantially parallel to ledge 2216.

Each side 2234 and 2236 may be offset a distance 2240 from ledge 2216. Each side 2234 and 2236 may be offset such that base 2020 may be inserted between ledge 2216 and flange 2238.

Flange 2238 also may include at least one opening 2248. Each opening 2248 may be configured to admit a fastener. Such a fastener may be, e.g., a #8 screw, having an OD of approximately 0.165". Also, in one embodiment, at least one opening 2248 is configured to be aligned with or concentric with at least one opening 2076 in portion 2060, such that a fastener may be inserted through both openings 2076 and 2248 coupling shelf 2200 to base 2020.

Each fastener may include a head having a recess, such as a Phillips recess, for receiving a rotary driver so that system may be installed with a driving tool, such as a screwdriver or a drill with a screwdriver bit. Recess includes one or more torque transmitting surfaces so that torque may be transmitted from the rotary driver to rotate the fastener in order to drive the fastener through the wall.

Each opening 2248 may be sized slightly smaller than major diameter of fasteners so as to meter fastener during installation, such that the head of each fastener engages shelf 2200 around opening 2248 and such that the threads of the fastener engage shelf 2200 to prevent stripping of the fastener.

Further, if flange 2238 has more than one opening 2248, the openings may have generally collinear centers to install fasteners along a common line. However, the openings may be horizontally offset from one another, staggered, or in any other configuration. Openings 2248 may be spaced equidistantly, for example, about every 2 inches.

Shelf 2200 may have a length 2249 between edges 2222 and 2224, such that length 2249 may be between about 6" and about 48", preferably between about 12" and about 36" and in one embodiment, about 24". In one embodiment, length 2249 is substantially the same as length 2031 of base 2020. Additionally, shelf 2200 may have a width 2250 between edges 2226 and 2228, such that width 2250 may be between about 2" and about 12", preferably between about 3" and about 7" and in one embodiment, about 6".

Continuing further with FIGS. 26 and 27, shelf 2200 may be comprised of a thin, relatively strong material to withstand repeated loading and unloading of items, such as tools. Shelf 2200 may be made of steel, plastic, or one or more other suitable materials. In one embodiment, shelf 2200 is made of rolled steel and may be of unitary construction. In another embodiment, shelf 2200 is made of a plurality of pieces operatively connected to one another, such as by welding, riveting or through other means.

Endcap 2300

System 2010 may further comprise one or more endcap 2300 that may be removably coupled to base 2020. As shown in FIGS. 23 and 24, endcap 2300 may have a shape configured to fit within channel 2170 of base 2020. End caps 2300 may add strength to system 2010 and/or to improve the aesthetic of system 2010 and/or may facilitate coupling a first system 2010 to a second system 2010, specifically when horizontally coupling a first base and a second base.

Endcap 2300 may be sized to couple to a side of base 2020 and may have any shape that facilitates coupling endcap to base 2020. In one embodiment, endcap 2300 may include an arcuate projection 2314 that is configured to engage indentation 2094 and/or an arcuate projection 2315 that is configured to engage indentation 2050.

Endcap 2300 has an outer surface 2302 that may be visible when endcap 2300 is coupled to base 2020. Additionally, endcap 2300 may include flanges 2310. Flanges 2310 may have any shape that facilitates insertion and removal of endcap 2300 with respect to base 2020. Flanges 2310 may facilitate coupling the end of one base 2020 to the end of another base 2020. Flanges 2310 also may facilitate aligning the bases together. Moreover, endcap 2300 may include indicia, such as the name of a company. Endcap 2300 also may include a lip to limit the distance that the endcap can be inserted into portion 2060.

In one embodiment, endcap 2300 is fabricated from a plastic material that may be extruded; however, in alternative embodiments, endcap 2300 may be fabricated from any suitable material.

While units may be self-contained such that a user can locate system at a desired location on mounting surface, a plurality of system 10 units may be joined or abutted to extend system 2010. Sides 2030 of base 2020 may be manufactured at a substantially equivalent angle so that a plurality of bases 2020 may abut when placed side-by-side. In one embodiment, side 2030 is generally straight such that sides 2030 are generally vertical when mounted on a wall.

Endcaps 2300 may be used with a single system 2010 or a plurality of systems 2010. When endcaps 2300 are used with a plurality of systems 2010, endcaps 2300 strengthen the connection between the systems and aid in aligning the systems with respect to one another and/or make system 2010 more aesthetically pleasing. Although endcaps 2300 may be used with multiple systems, endcaps 300 may be removable prior to coupling systems 2010 together. For example, if endcaps 2300 are removed, system 200 may have a different type of connection, such as a friction fit, tongue and channel connections, tabs with mating recesses, etc.

Accessory or Accessories 2400

System 2010 may further include one or more of a variety of accessories 2400, such as pegs, pins, hooks, receptacle, bins, magnetic strips, and/or the like, that may couple to and be spaced along a length of base 2020. In one embodiment, accessories 2400 are coupled to portion 2060 of base 2020 and/or shelf 2200. In another embodiment, accessories 2400 may be coupled directly to a wall or mounting surface with at least one fastener.

Accessories 2400 may come in a variety of configurations to perform a variety of functions. For example, some hooks may be a long or short straight-sided hook, a long or short deep straight-sided hook, a straight or curved-sided single hook for use, for example, in holding a hose, a straight-sided curved hook or a paper towel holder, and some bins may be wide and some may be narrow.

Turning to FIGS. 28-33, an accessory 2400 may include a flat, generally planar, generally rectangular metal flange or base plate or mounting plate or accessory plate 2402.

Base plate 2402 may be made of sheet metal having an outer surface 2403 and an inner surface 2405 and may have a thickness between about 10 gauge and about 20 gauge, preferably between about 14 gauge and about 18 gauge, more preferably about 16 gauge. Alternatively, base plate 2402 is made of any suitable material to facilitate operation and utility of accessory 2400. Base plate 2402 may be stamped from sheet metal in a generally rectangular shape that may be between about 0.5" and about 5" tall from a top 2410 to a bottom 2412, preferably between about 1" and about 4", more preferably about 2". Base plate 2402 may also be between about 0.5" and about 5" wide, preferably between about 1" and about 4", and in one embodiment, about 2" inch. In another embodiment, base plate 2402 is made of a plastic material.

Figure 28:
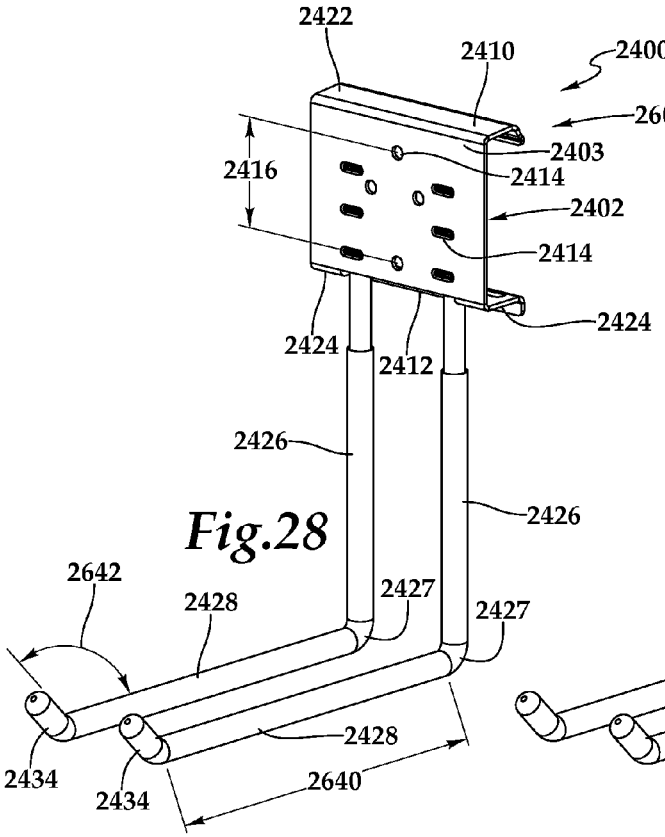
FIG. 28 is a front perspective view of one embodiment of an accessory.

Base plate 2402 further may have a plurality of openings and/or slots 2414 stamped out of plate 2402 to enable accessory 2400 to be mounted to a variety of surfaces. Openings 2414 may be sized to accommodate fasteners or an accessory cover 2450. Each opening 2414 may have a diameter between about ¼" and about ¾" and, in one embodiment, about 0.188". Openings 2414 may be substantially symmetrically formed about a center 2420 of base plate 2402. Openings 2414 may be positioned at a predetermined distance 2416 apart. In one embodiment, as shown in FIG. 28, distance 2416 may be positioned between about 0.5" inch and about 6", preferably between about 1" and about 4" inch and, in one embodiment, about 1.5" or 1.550" apart. Additionally, openings 2414 may facilitate coupling accessories 2400 directly to a wall or mounting surface with at least one fastener.

Base plate 2402 also may include tabs that are configured to engage base 2020. In one embodiment, as shown in FIG. 28, base plate 2402 includes at least one tab, an upper tab 2422 extending outward and downward from surface 2405 proximate top 2410 and a pair of lower tabs 2424 extending outward and downward from surface 2405 proximate bottom 2412, as shown in FIG. 28. For example, upper tab 2422 may have a hook shape configured to engage portion 2080 of base 2020. In one embodiment, upper tab 2422 is shaped and sized substantially similar to portion 2080 such that tab 2422 may engage or interface with portion 2080. In one embodiment, the pair of lower tabs 2424 are shaped and sized substantially similar to channel 2172 such that tabs 2424 may engage or interface with portions 2032 and 2040 of base 2020. In one embodiment, tabs 2424 may have a distance between them, such that a wireform 2404 may extend between tabs 2424.

Tabs 2422 and 2424 may vary in length and width, but, in one embodiment, tab 2422 may extend substantially the width of base plate 2402. Tab 2422 may be coupled to and/or over portion 2080 of base 2020. Tabs 2424 are configured to couple to under portions 2032 and 2040, accessory 2400 may be effectively locked into position, restraining accessory 2400 from movement other than laterally along portion 2060. In one embodiment, tabs 2424 may be fabricated from a plastic material. Alternatively, tabs 2424 may be fabricated from any other suitable material, such as sheet metal.

Figure 30:
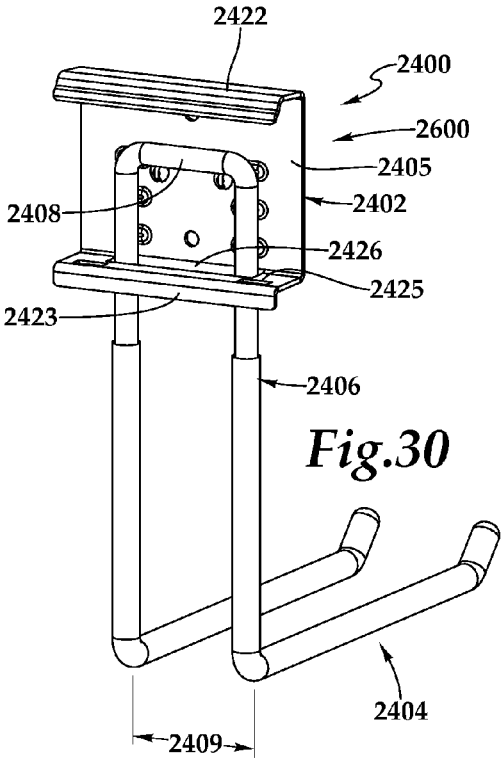
FIG. 30 is a rear perspective view of one embodiment of an accessory.

Alternatively, as shown in FIG. 30, base plate 2402 does not include a pair of lower tabs 2424, but rather includes a unitary or single lower tab 2423 with an opening 2426 to accommodate wireform 2404.

Figure 31:
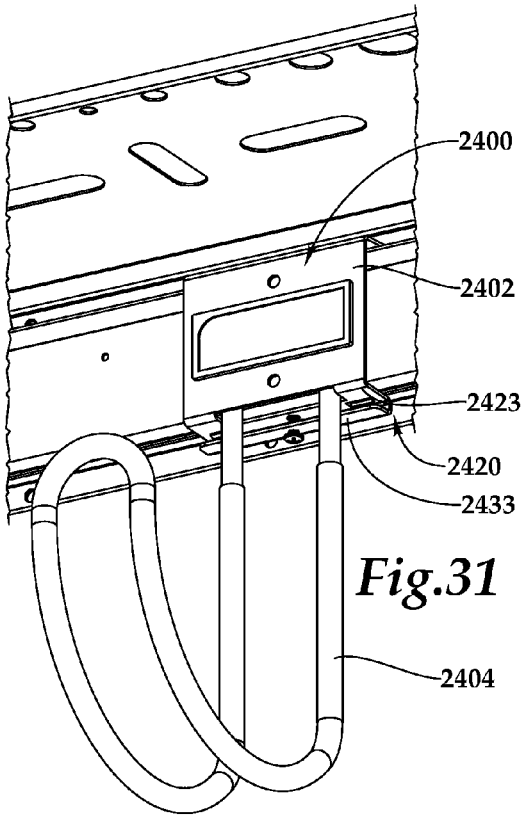
FIG. 31 is a perspective view of another embodiment of an accessory.
Figure 32:
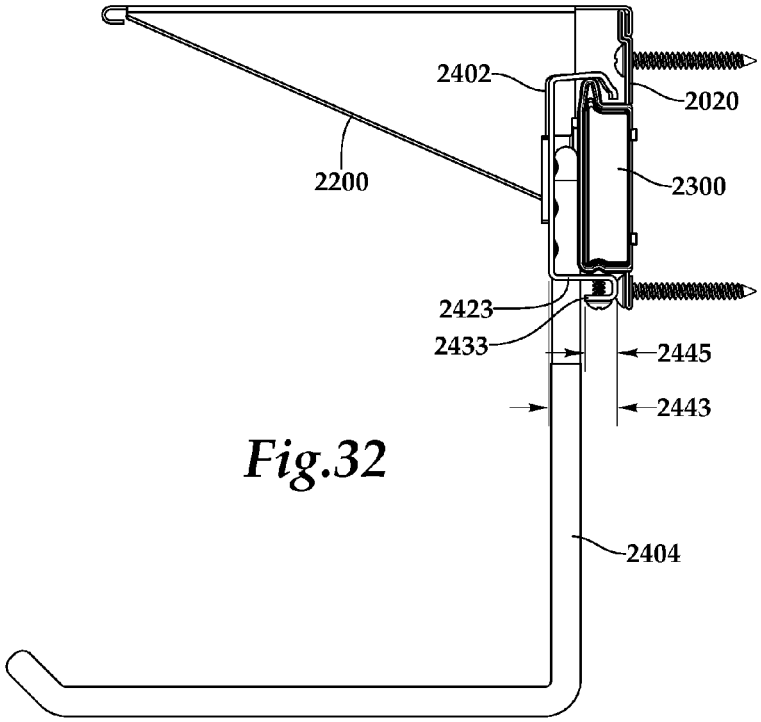
FIG. 32 is a side view of the accessory of FIG. 29.
Figure 33:
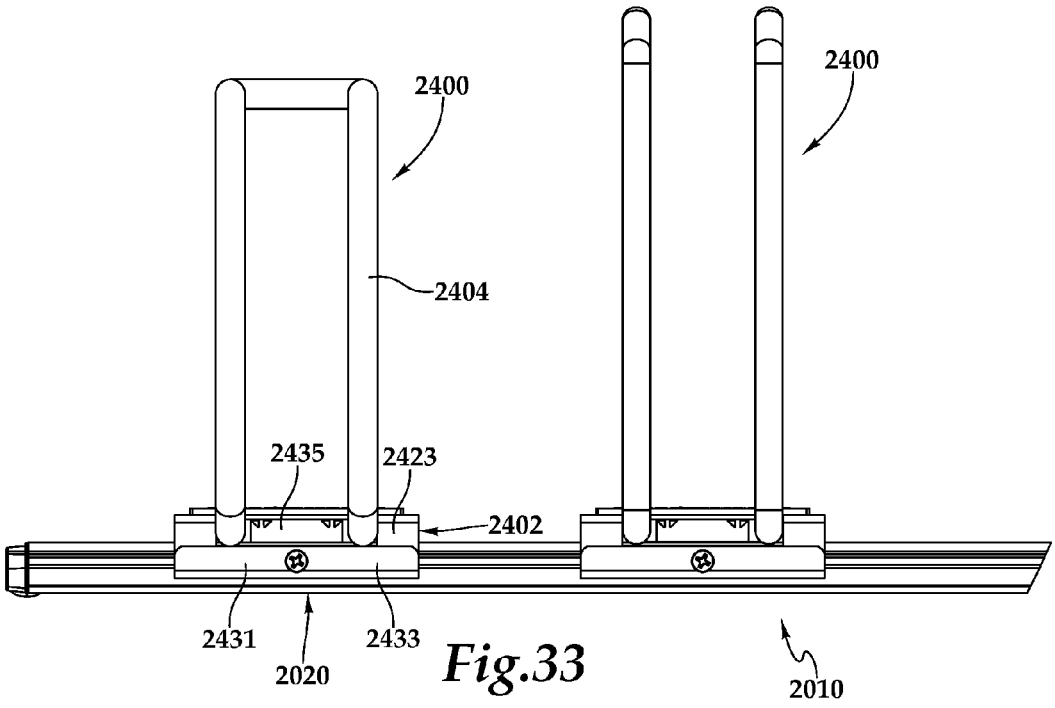
FIG. 33 is a bottom view of the accessory of FIG. 29.

In a further alternative embodiment, as shown in FIGS. 31-33, accessory 2400 may include a base plate 2402 that includes a unitary or single lower tab 2423 having a surface 2431 that extends outward and rearwardly from surface 2403 and an additional flange 2433 that extends inward back towards surface 2403. Flange 2433 has a surface 2435 that may be substantially parallel to surface 2431. In one embodiment, surface 2435 is spaced a distance 2437 from surface 2431.

In one embodiment, as shown in FIG. 32, surface 2435 has a width 2443 and surface 2431 has a width 2445, wherein width 2445 is less than width 2443 to enable wireform 2404 to extend downward through surface 2435 without interfering with surface 2431.

Additionally, as shown in FIG. 32, an opening 2439 is formed within surface 2431 and an opening 2441 is formed within surface 2435. In one embodiment, opening 2439 and opening 2441 are collinear. Openings 2439 and 2441 may be configured to receive a fastener 2449, such as a screw, therein. In one embodiment, the fastener is sized to extend through both surfaces 2431 and 2435 and engage or abut projection 2050 of base 2020. Specifically, in one embodiment, the head of the fastener is configured to engage or abut surface 2431, such that the body of the fastener is substantially normal to surfaces 2431 and 2435.

The fastener may be installed or coupled to flange 2433 of base plate 2402 during production and remain within flange 2433. The fastener in flange 2433 will not interfere with the installation or coupling of base plate 2402 of accessory 2400 to base 2020. Once base plate 2402 is coupled to base 2020, the fastener can be tightened until it engages or abuts projection 2050 and/or a portion of base 2020. Tightening the fastener will minimize lateral movement of accessory 2400 along base 2020.

Additionally, as shown in FIGS. 30 and 32, base plate 2402 further may include at least one projection 2425. Specifically, tab 2423 or tabs 2424 may each have a projection 2425 extending therefrom. Each projection 2425 may be configured to engage indentation 2050 of base 2020, when base plate 2402 is coupled to base 2020.

Turning to FIGS. 28-33, in addition to base plate 2402, at least one accessory 2400 may include a generally symmetrical wireform 2404 having a predetermined shape and having a pair of legs 2406 with a portion or brace 2408 therebetween, wherein brace 2408 may increase rigidity and inhibit bending. In one embodiment, brace 2408 is substantially normal to legs 2406 and is configured to position legs 2406 at a predetermined distance 2409 apart. In one embodiment, as shown in FIG. 30, distance 2409 may be positioned between about 0.5" inch and about 6", preferably between about 1" and about 4" inch and, in one embodiment, about 2" or 1.930" apart.

Wireform 2404 may be welded to base plate 2402 wherever wireform contacts base plate 2402. Preferably, brace 2408 has a welded length between about ½ inch and about 1½ to secure wireform 2404 to base plate 2402. Several types of welds may be used, including spot welds. More preferably, however, connection is a fillet weld. Fillet weld may be between about ⅙ inch and about ⅜ inch, preferably about ⅛ inch. In addition, fillet weld may extend substantially around a perimeter defining the contact between base plate 2402 and legs 2406.

In one embodiment, wireform 2404 is coupled to surface 2405. Alternatively, wireform 2404 may be coupled to surface 2403.

Legs 2406 also may be joined at a forward end to form a continuous structure extending down from base plate 2402, along legs 2406 and back to base plate 2402. At least one and potentially two or more legs 2406 extend downward or outward from base plate 2402 for holding an object. Leg(s) 2406 are spaced to improve the load capacity for accessory 2400.

When accessory 2400 is coupled to base 2020, legs 2406 may be spaced a small predetermined distance from wall or mounting surface. In this way, loading on system 2010 and fasteners may have a larger shear component than a bending component, thereby increasing the holding strength of system 2010.

Legs 2406 may have upturned ends to prevent objects from sliding off accessory 2400 or from being accidentally dislodged from accessory 2400. Leg 2406 may also be coated with a rubberized or plasticized material to increase friction between leg 2406 and object, further inhibiting sliding of object.

Legs 2406 may extend outward in varying degrees to allow system 2010 to store a variety of products. For example, accessories 2400 may extend substantially the same distance from a wall or mounting surface as shelf 2200, 2220 to hold wider objects, such as a hose. Further, accessories 200 may also be spaced apart to allow passage of an object, such as a broom or shovel handle, while allowing the broom head or shovel to rest on legs.

Legs 2406 may come in many configurations, including straight legs, J-shaped legs, C-shaped legs, bicycle hooks, ladder hooks, tool hooks, coat or hat hooks, or a U-shaped pair of legs. Each leg 2406 may extend axially out from base plate 2402, but, preferably, legs 2406 may extend laterally along an outer surface that may be substantially parallel to the wall before extending away from base plate 2402.

Accessory Cover 2450

Figure 29:
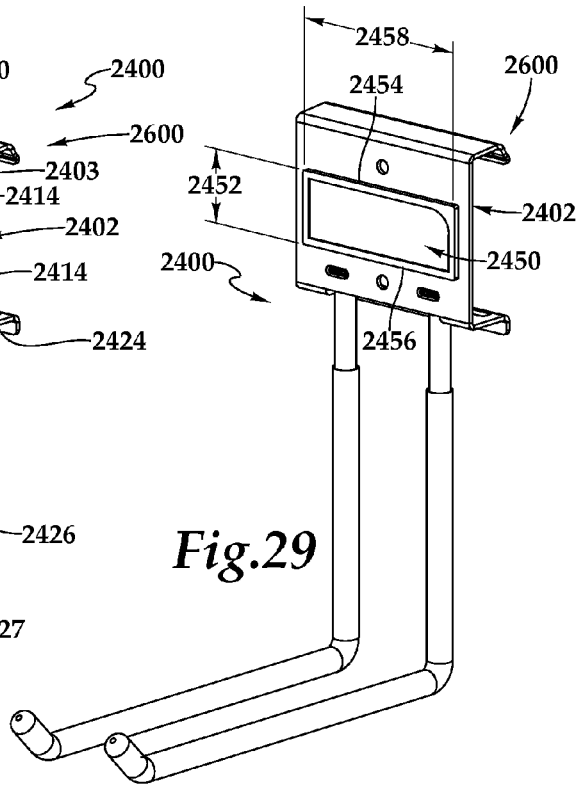
FIG. 29 is a front perspective view of the accessory of FIG. 28 with an accessory cover.

Turning to FIG. 29, accessory 2400 may include an accessory cover 2450 that is sized and shaped to couple to base plate 2402. Cover 2450 may have a height 2452 between a top 2454 and a bottom 2456, a width 2458 and a thickness. In one embodiment, cover 2450 has flanges extending from cover 2450 to engage openings 2414. Alternatively, cover 2450 may be coupled to base plate 2402 using any suitable manner. Height 2452 may be between about 0.5" and about 5, preferably between about 1" and about 4", and in one embodiment about 2". Similarly, width 2458 may be between about 0.5" and about 5" wide, preferably between about 0.75" and about 4", and in one embodiment, about 1" inch. In one embodiment, cover 2450 may be fabricated from a plastic material; however, in alternative embodiments, cover 2450 may be fabricated from any suitable material.

Accessory 2500

Returning to FIG. 23, in one embodiment, an accessory 2500 includes a base plate 2402 and a pair of legs 2406. In one embodiment, legs 2406 may have a first segment 2426 extending generally parallel to the base plate 2402 and a second segment 2428 extending outwardly of the base plate 2402. Legs 2406 are diametrically opposed, symmetrical about a vertical axis, and may extend downward from surface 2405 before bending to form a distal portion 2432. Legs 2406 also have a segment 2428, which has a radius of curvature, and extends between segment 2426 and portion 2432. Distal portion 2432 may have a connection 2436 extending between legs 2406. In one embodiment, connection 2436 has an arcuate shape. Alternatively, connection 2436 may have any suitable shape.

Accessory 2600

Continuing with FIG. 23, in one embodiment, an accessory 2600 is similar to accessory 2500, including segments 2426; however, segment 2428 is substantially normal to segment 2426 via a bend 2427 and accessory 2600 does not include a connector 2436. Segment 2428 of accessory 2600 has a width 2640. Width 2640 may be between about 2" inch and about 12", preferably between about 4" and about 8" inch and, in one embodiment, about 6.599".

Each leg 2406 may have a foot 2434 or an upturned end proximate distal portion to prevent the object from sliding off or tipping over the end of legs 2406. Upturned end or foot may have a height between about 0.25" inch and about 2", preferably between about 0.5" and about 1.75" inch and, in one embodiment, about 1.171". In one embodiment, first segment 2426 may have a height 2438 that may be between about 2" inch and about 12", preferably between about 4" and about 8" inch and, in one embodiment, about 5.180", and second segment 2428 may have a width 2440 that may be between about 2" inch and about 12", preferably between about 4" and about 8" inch and, in one embodiment, about 6".

In one embodiment, as shown in the figures, foot 2434 of accessory 2600 may form an obtuse angle 2642 with respect to segment 2428, wherein angle 2642 may be between about 91 degrees and about 175 degrees, preferably between about 100 degrees and about 150 degrees, and in the embodiment, about 135 degrees. Alternatively, foot 2434 may be substantially normal to segment 2428.

Accessory 2700

Further continuing with FIG. 23, accessory 2700 may be a two-handle hook, wherein the hooks pivot proximate base 2402. Accessory 2700 may have a storage position, shown in FIG. 23, and an erect position. In the erect position, the hooks may pivot proximate base 2402 to hold items such as a broom, rake, shovel, mop or the like.

The hooks of accessory 2700 include a first segment 2702 that extends from base 2402, wherein first segment 2702 is substantially parallel to surface 2405 of base 2402. A second segment 2704 may be configured to extend between first segments 2702 and may have any shape. In one embodiment, second segment 2704 may have an arcuate, oval shape. Accessory 2700 further includes a connector or hinge 2706 that facilitates pivoting and connection between segment 2704 and a third segment or hook 2708. In one embodiment, accessory 2700 includes two hooks 2708, wherein each hook 2708 has an L-shaped portion and a U-shaped arcuate portion extending therefrom via a bend. Further, in one embodiment, the U-shaped portions may be turned outward, such that the hooks do not face one another.

Peg 2800

As further shown in FIG. 23, an accessory 2800 may be coupled to, screwed into or fastened to base 2020 within openings 2076. Accessory 2800 may be a peg or other mechanism to enable a user to hang an object thereon. Additionally, accessory 2800 may be positioned at various predetermined positions along base 2020.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A wall-mountable storage system comprising:

a base having a first edge and a second edge, and comprising a first wall engaging portion proximate the first edge, a second wall engaging portion spaced from the first wall engaging portion and proximate the second edge, wherein the first and second wall engaging portions are generally parallel to each other, and an accessory portion extending outwardly from the first and second wall engaging portions, the accessory portion having a first extension reaching from the first wall engaging portion, a second extension reaching from the second wall engaging portion and having an indentation in the direction of the first edge, a protrusion extending from the second extension to an accessory engaging portion extending past the first extension in the direction of the first edge to a distal end and bending back to connect to the first extension, wherein the first wall engaging portion, the first extension, and the accessory engaging portion form a channel; and at least one accessory configured to engage the accessory portion.

2. A storage system in accordance with claim 1, wherein the second wall engaging portion is configured to abut a wall.

3. A storage system in accordance with claim 1, wherein the at least one accessory comprises a base plate with at least two rearwardly extending tabs and a generally symmetrically wireform having a pair of legs with a portion therebetween, wherein the base plate is configured to couple to the accessory portion.

4. A storage system in accordance with claim 3, wherein the base plate further comprises an additional flange, wherein a first opening is defined within the at least one rearwardly extending tab and a second opening is defined within the additional flange, and further wherein the first and second openings are collinear.

5. A storage system in accordance with claim 4, wherein a fastener is configured to be inserted through the first and second openings and the fastener is configured to engage a projection defined within the accessory portion.

6. A storage system in accordance with claim 3, wherein the at least one accessory further comprises a base plate having a front surface and a rear surface with a wireform coupled to the rear surface.

7. A storage system in accordance with claim 1, wherein the accessory portion includes a plurality of openings therein, wherein each opening is configured to receive a fastener.

8. A storage system of claim 1, wherein the entire base is formed substantially from a single sheet of metal.

9. A storage system of claim 1, wherein the wall engaging portions are folded over.

10. A storage system in accordance with claim 1, further comprising an upper ledge between the first edge and the first wall engaging portion, the upper ledge being spaced outwardly from and substantially parallel to the first wall engaging portion.

11. A storage system in accordance with claim 10, further comprising at least one shelf having a ledge configured to couple to both the upper ledge and the accessory portion.

12. A storage system in accordance with claim 10, wherein the accessory portion is spaced a predetermined distance from the wall engaging portions, which is greater than a distance that the upper ledge is spaced from the wall engaging portions.

13. A storage system in accordance with claim 1, wherein a height of the protrusion is more than three times a height of the second engaging portion.

14. A storage system in accordance with claim 1, wherein the accessory engaging portion comprises an outer part that is angled inwardly from the protrusion to the distal end.

15. A storage system in accordance with claim 14, wherein the accessory portion further comprises an inner part that is angled outwardly from the first extension to the distal end.

* * * * *